United States Patent [19]

Moody et al.

[11] 4,417,394

[45] Nov. 29, 1983

[54] METHOD AND APPARATUS FOR POSITIONING AN EXPANDABLE INSULATING SLEEVE ON A CONNECTOR

[75] Inventors: Roy A. Moody, Flossmoor; John J. Bulanda, New Lenox; Cazimir M. Guzay, Des Plaines, all of Ill.; David R. Schoenfeld, Salt Lake City, Utah

[73] Assignee: Panduit Corp., Tinley Park, Ill.

[21] Appl. No.: 781,907

[22] Filed: Mar. 28, 1977

Related U.S. Application Data

[62] Division of Ser. No. 709,845, Jul. 29, 1976, abandoned.

[51] Int. Cl.[3] ..... H01R 43/00

[52] U.S. Cl. ..... 29/882; 29/745; 29/747; 29/858; 29/859; 29/883; 29/235; 29/450

[58] Field of Search ..... 29/629, 631, 748, 747, 29/745, 754, 819, 235, 282, 234, 717, 450, 882, 883, 858, 859

[56] References Cited

U.S. PATENT DOCUMENTS

| | | | |
|---|---|---|---|
| 2,271,077 | 1/1942 | Judisch | 29/754 |
| 2,278,176 | 3/1942 | Herman | 29/754 |
| 2,683,924 | 7/1954 | Schryver | 29/754 |
| 2,686,357 | 8/1954 | Weisberg | 29/754 |
| 2,813,331 | 11/1957 | Hohl | 29/450 |
| 3,192,616 | 7/1965 | Austin et al. | 29/450 |
| 3,605,239 | 9/1971 | Eschholz | 29/235 |
| 3,611,536 | 10/1971 | Guenther et al. | 29/450 |
| 3,781,985 | 1/1974 | Yonkers | 29/754 |
| 3,842,483 | 10/1974 | Cramer | 29/450 |
| 3,851,369 | 12/1974 | Eschholz | 29/117 |
| 3,900,941 | 8/1975 | Browning et al. | 29/450 |
| 3,955,414 | 5/1976 | Anderson | 29/747 |

FOREIGN PATENT DOCUMENTS

| | | | |
|---|---|---|---|
| 177167 | 3/1922 | United Kingdom | 29/450 |
| 1206654 | 9/1970 | United Kingdom | 29/235 |
| 1210376 | 10/1970 | United Kingdom | 29/629 |

*Primary Examiner*—Daniel C. Crane

*Attorney, Agent, or Firm*—Charles R. Wentzel; Mark D. Hilliard

[57] ABSTRACT

Apparatus for insulating a connector, mechanically joined to one end of an electrical conductor, by positioning a radially expandable resilient insulating sleeve, having an inside diameter in its non-expanded condition smaller than the largest cross-sectional dimension of the connector, about the connector. The connector includes one end portion mechanically joined to the conductor and a terminal end portion for connection to another electrical component. The apparatus of the present invention includes expansion means for expanding the sleeve sufficiently to receive the connector and holding means for maintaining the sleeve in its expanded condition and for permitting the connector to be received, terminal end portion first, into the expanded sleeve. The apparatus further includes release means operable to release the sleeve from its expanded condition whereby after the sleeve is held expanded and said connector inserted therein, operation of the release means frees the sleeve to become disposed about and compressively hold said connector.

As a method, the invention comprises several steps. The sleeve is expanded sufficiently to receive the connector and held in its expanded condition. Thereafter, the connector is inserted, terminal end portion first, into the expanded sleeve. Finally, the sleeve is released from its expanded condition whereby it contracts about and effectively insulates the connector.

22 Claims, 38 Drawing Figures

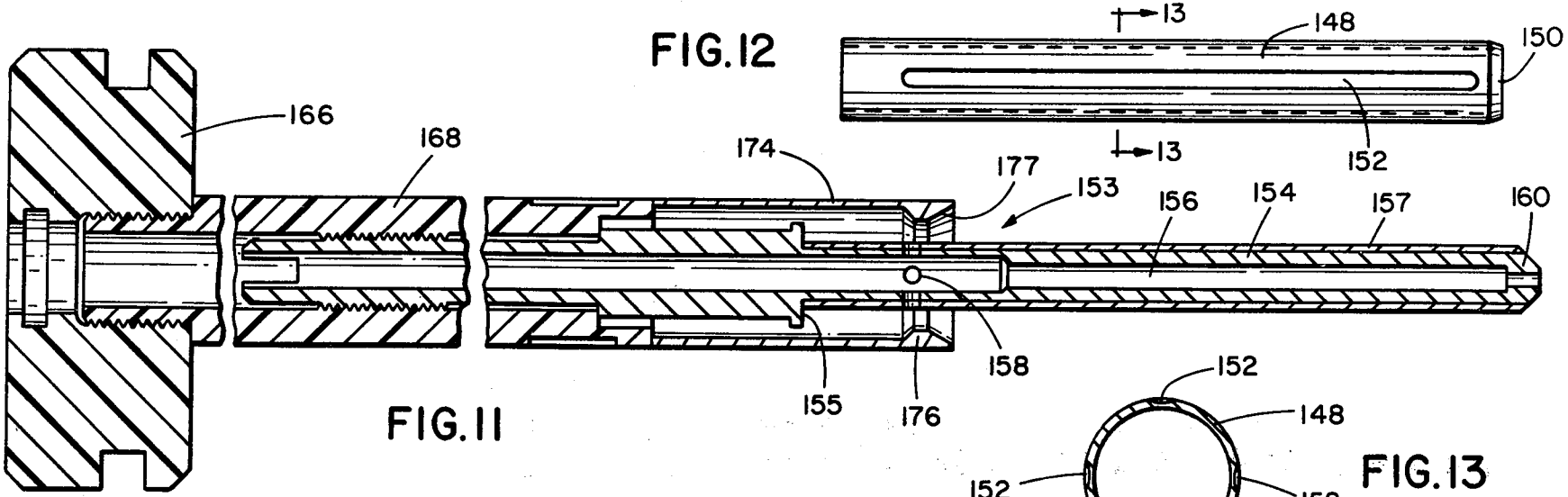
FIG. 12
FIG. 11
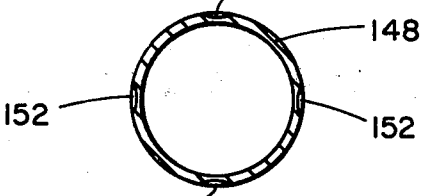
FIG. 13
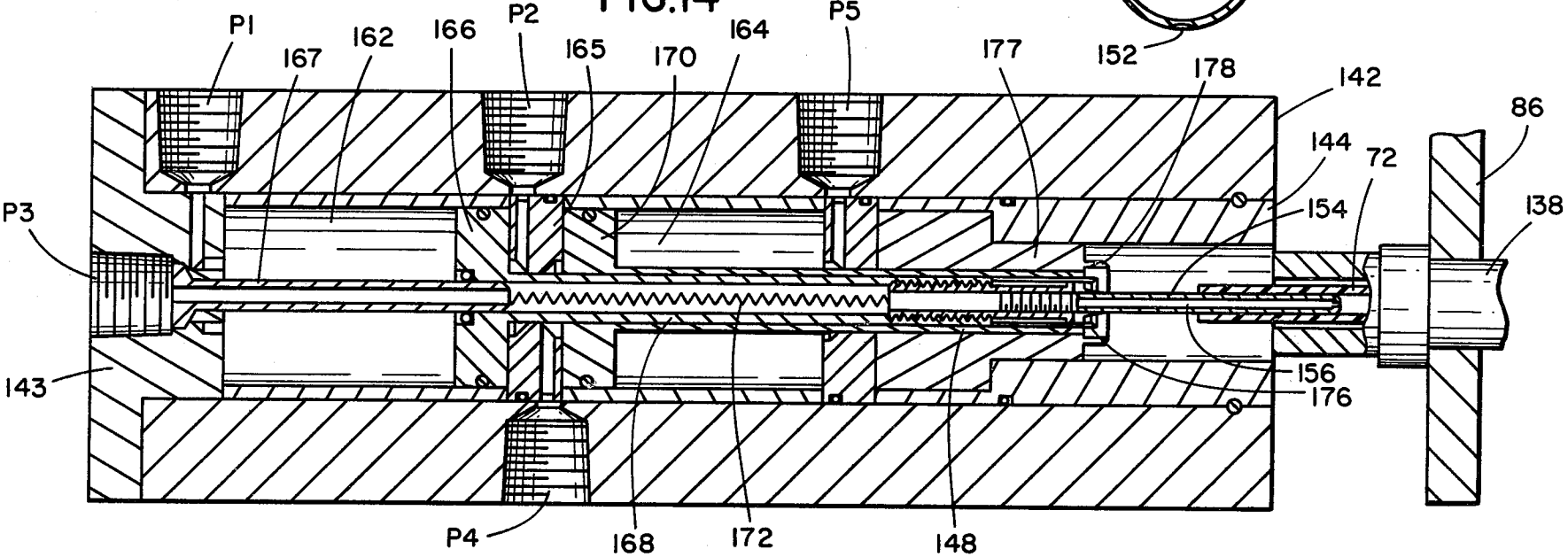
FIG. 14

METHOD AND APPARATUS FOR POSITIONING AN EXPANDABLE INSULATING SLEEVE ON A CONNECTOR

This is a division of application Ser. No. 709,845, filed July 29, 1976, now abandoned.

BACKGROUND OF THE INVENTION

This invention relates to a method and apparatus for insulating an electrical component and, more particularly, to such method and apparatus for applying an expandable resilient insulating sleeve over a connector by first expanding the sleeve to receive the connector and thereafter releasing the sleeve to contract about the connector.

Electrical connectors such as female disconnects are typically insulated by either mechanically driving a sleeve of thermoplastic material, sized for an interference fit, over the connector or by placing the connector in an oversized sleeve of heat-shrinkable plastic material and applying heat until the sleeve has shrunk sufficiently to compressively hold the connector. A sleeve is applied via the first method only before the connector is crimped to a wire because, after crimping, only one end of the connector is accessible and the connector is difficult to hold firmly. It is relatively expensive to preinsulate connectors and crimping a preinsulated connector onto a wire has certain disadvantages in that a burr or piece of foreign matter on the crimping jaws could cause piercing of the sleeve. Also, a portion of the sleeve could be overstressed during crimping resulting in a nonuniformity of dielectric constant and requiring the sleeve to be relatively thick to insure provision of the necessary insulation characteristics.

Heat shrinkable tubing is typically applied after the connector has been joined to the wire. Heat shrinking the tubing is a relatively slow process; heat application times of ten seconds are not uncommon. Such tubing is also relatively expensive and care must be taken not to overheat the insulation on the wire when the sleeve is being applied to a connector already crimped onto a wire.

In another method of insulating a terminal, two insulating sleeve halves joined along one margin are folded to enclose the terminal. The other sides of the halves either have interlocking latch means or they are sonically welded together. This method includes many operations and is quite costly.

Apparatus has been proposed for stretching one end of a resilient insulating sleeve along parallel planes to provide an opening sufficiently large to receive a terminal. Such apparatus is part of a connector applying press and includes a pair of small fingers extending in the longitudinal direction of the sleeve. These fingers extend approximately to the midpoint of the sleeve and are movable to a spaced position wherein they extend one end portion of the sleeve. This method of mechanical expansion requires that the insulated wire to be terminated and to receive the sleeve have a smaller outside diameter than the inside diameter of the non-stretched portion of the sleeve and further requires the wire to be slid through the sleeve until the stripped end of the wire extends far past the fingers, a connector be positioned within the expanded portion of the sleeve. Thus, both ends of the sleeve must be accessible: the first end to slide the wire through the sleeve and the other end to terminate the wire and slide the connector back into the stretched portion of the sleeve. Reference may be made to U.S. Pat. Nos. 3,289,284 and 3,609,860.

Apparatus has also been proposed for inserting a generally cone shaped inner lining of ribbon film into a connector to serve as a guide for directing wires past protuberances extending inside the connector before the connector is deformed to mechanically engage the wires. The apron of the film extending outside the connector is folded back on itself and secured to the outside surface of the connector by using an annular elastic band. The connector is generally elliptical in cross section and as the minimum external width of the connector is less than the inside diameter of the band, the band is stretched only along parallel planes before being placed over the connector and the doubled back film apron. Reference may be made to U.S. Pat. No. 3,781,985.

SUMMARY OF THE INVENTION

Among the several objects of this invention may be noted the provision of an improved method and apparatus for applying an insulating sleeve to a connector having previously been attached to a wire as by crimping thereby avoiding damage to the sleeve that could occur if the crimping operation occurred after application of the insulating sleeve; the provision of such apparatus which generally uniformly expands the sleeve to avoid high localized stress concentrations therein; the provision of such apparatus which can install a sleeve having, in its stable condition, an inside diameter smaller than the outside diameter of the wire so that the sleeve, after application, compressively holds not only the connector but also the wire adjacent the connector; the provision of such apparatus which securely positions the insulating sleeve about the connector very quickly and precludes the degradation of the insulation on the wire by avoiding the use of heat; the provision of such apparatus which is responsive to proper positioning of the connector to apply the sleeve; and the provision of such apparatus which is reliable in use and has long service life. Other objects and features of the present invention will be in part apparent and in part pointed out hereinafter in the specification and claims.

Briefly, the apparatus of the present invention includes expansion means, holding means, and release means. The expansion means radially expands the sleeve along nonparallel planes sufficiently to receive the connector while the holding means maintains the sleeve in its expanded condition and permits the connector to be received, terminal end portion first, into the expanded sleeve. The release means is operable to release the sleeve from its expanded condition so that after the sleeve is held expanded and the connector inserted therein, operation of the release means frees the sleeve to become disposed about and compressively hold the connector. As a method, the sleeve is radially expanded along non-parallel planes sufficiently to receive the connector and the sleeve is held in its expanded condition while the connector is inserted, terminal end portion first, into the sleeve. Thereafter, the sleeve is released so that it contracts about and effectively insulates the connector.

BRIEF DESCRIPTION OF THE DRAWINGS

FIG. 11 is a sectional view of the tube mandrel;

FIG. 12 is a plan of the shear tube;

FIG. 13 is a sectional view of the shear tube of FIG. 12 taken generally along line 13—13;

FIG. 14, similar to FIG. 9, shows the sleeve installer aligned with the feeder with the arbor extended, and the installer receiving the end portion of a length of tubing;

Corresponding reference characters indicate corresponding parts throughout the several views of the drawings.

DESCRIPTION OF THE PREFERRED EMBODIMENTS

Figure 1:
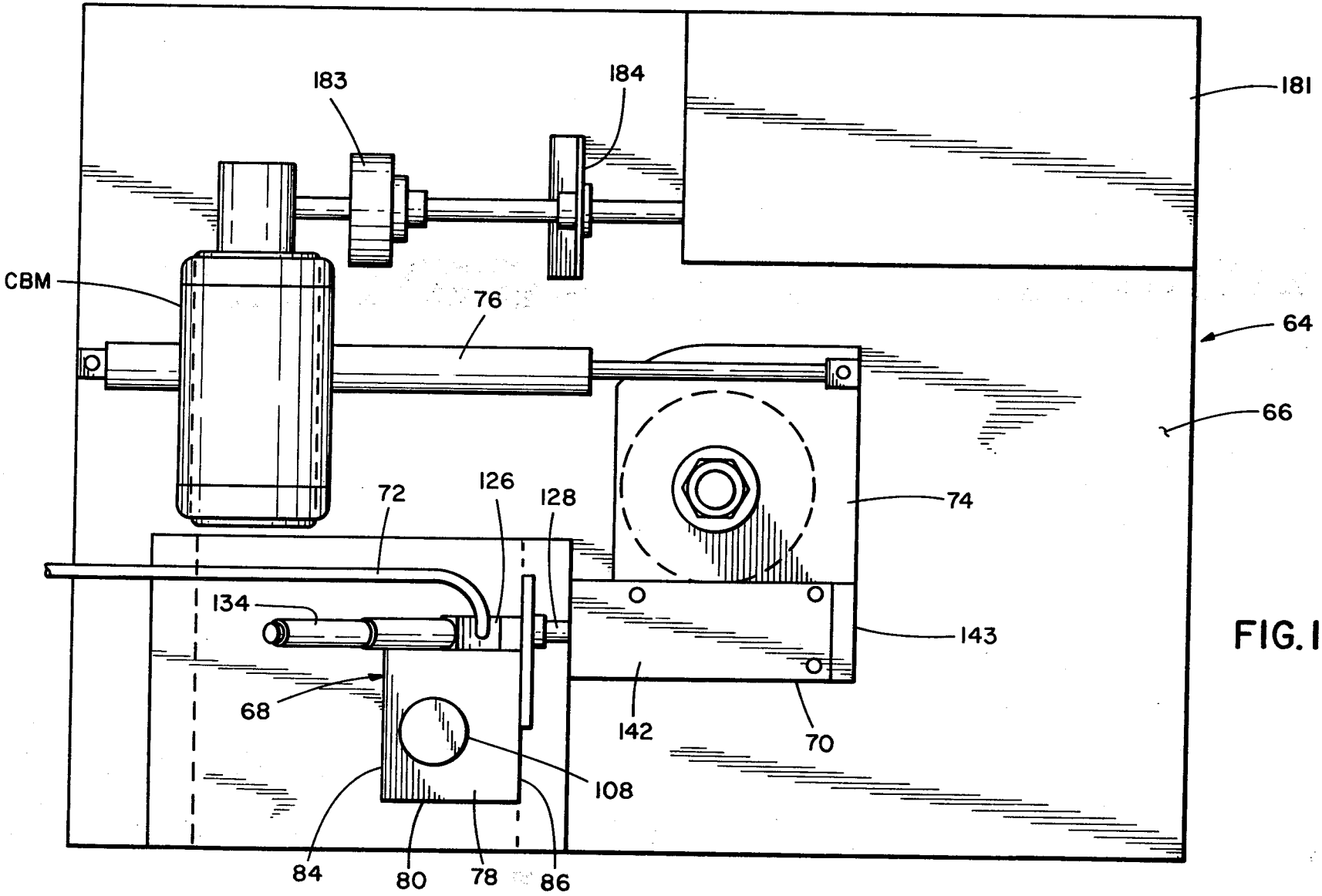
FIG. 1 is a plan of apparatus of the present invention including a tubing feeder and a sleeve installer showing the sleeve installer in position to receive a length of tubing from the feeder.
Figures 2, 3, 4:
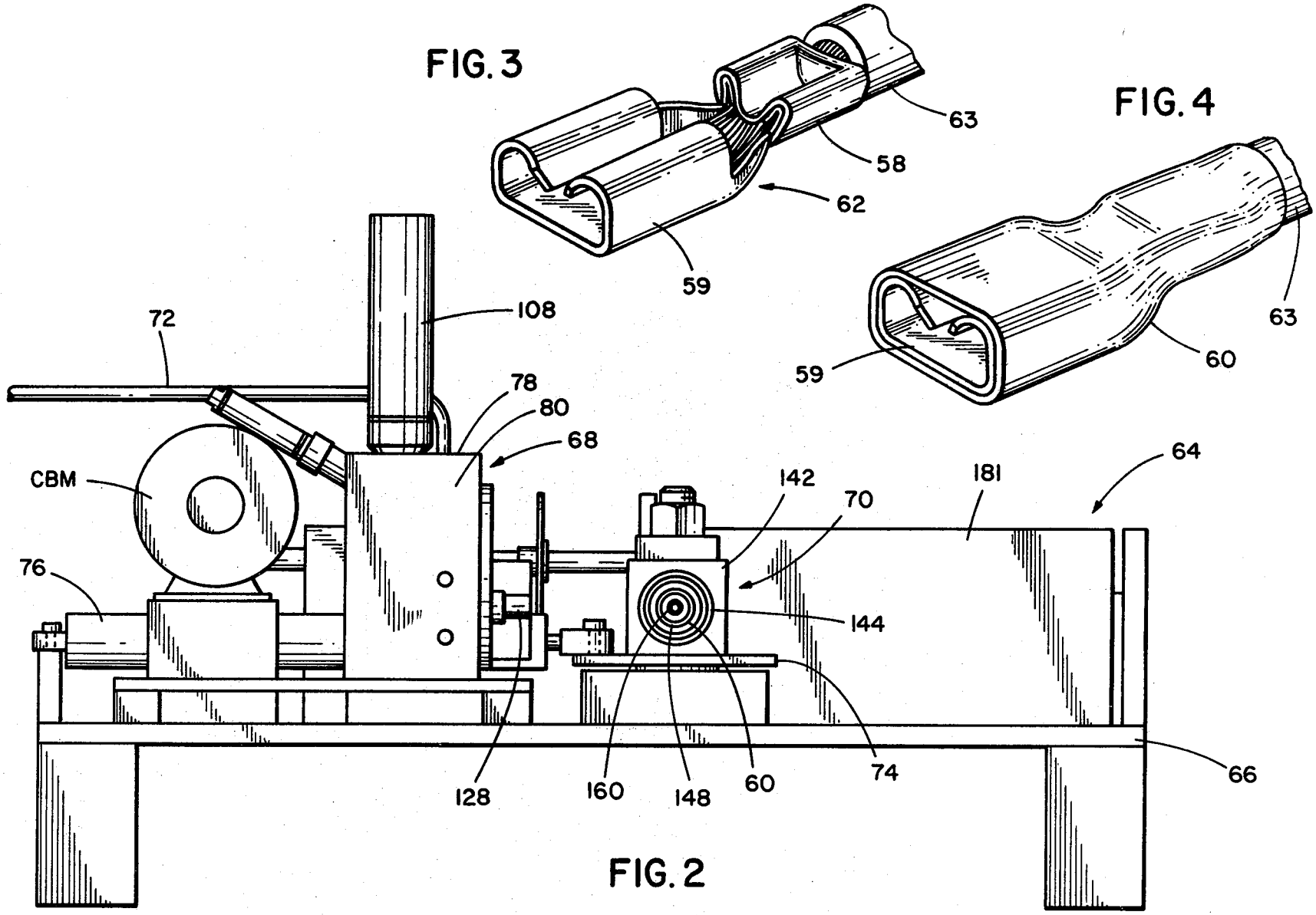
FIG. 2 is a front elevational view of the apparatus showing the sleeve installer holding an expanded sleeve and in position to receive a connector to be insulated.
FIG. 3 is a perspective view of a connector to be insulated having its ferrule portion crimped onto the stripped end of a wire.
FIG. 4 is a perspective view of the connector of FIG. 3 after the insulating sleeve has been applied.

Referring now to the drawings, apparatus of the present invention for applying a radially expandable resilient insulating sleeve 60, shown in FIG. 4, to an object such as an electrical connector 62, shown in FIG. 3 mechanically joined to an insulated wire 63, is generally indicated in FIGS. 1 and 2 by reference numeral 64. More specifically, connector 62 is shown as a female disconnect including a barrel end portion 58 crimped on the stripped end of wire 63 and a terminal end portion 59 for connection to another electrical component (not shown). Sleeve 60 is severed from the remainder of a length of radially expandable resilient insulating tubing 72 having an inside diameter, in its non-expanded condition, smaller than at least the largest cross-sectional dimension of connector 62. The sleeve has a length at least substantially equal to that of barrel end portion 58 of connector 62 and preferably has an inside diameter, in its non-expanded condition, smaller than the outside diameter of the insulated wire 63 so that the sleeve after application compressively holds not only connector 62 but also the portion of wire 63 adjacent barrel end portion 58 to preclude the possibility of electrically shock to the user of the insulated connector.

Sleeve applying apparatus 64 can conveniently be mounted on a shop worktable 66 and comprises a tubing feeder 68 and a sleeve installer 70. Various electrical and pneumatic components for effecting operation of the feeder and installer will be more fully described hereinafter. Feeder 68 operates to selectively convey a portion of the length of tubing 72 into the sleeve installer. The installer 70 thereafter functions to expand the leading portion of the tubing, sever the tubing thereby separating the expanded sleeve from the remainder of the length of tubing, hold the sleeve in its expanded condition until a connector is positioned in the installer, and release the sleeve to contract about the connector. Installer 70 is carried by a turntable 74 pivotally mounted on worktable 66 and is movable between a first position, shown in FIG. 1, wherein the installer is aligned with the feeder 68 to receive tubing and a second position, shown in FIG. 2, wherein the sleeve installer is remote from the feeder to receive the connector 62, having its barrel end portion 58 already crimped onto a conductor 63 to be insulated. A standard air cylinder 76 may be employed to effect indexing of the installer between its tubing-receiving position and its connector-receiving position.

Feeder 68, best shown in FIGS. 5–8, comprises means for conveying the tubing into the installer, unidirectional drive means for driving the conveying means in only the tubing advancing direction, and means for selectively compressing the tubing thereby to form a seal generally resistant to the passage of a fluid such as air. The feeder 68 has a frame including top, front, back and side walls, 78, 80, 82, 84, and 86, respectively.

Figure 5:
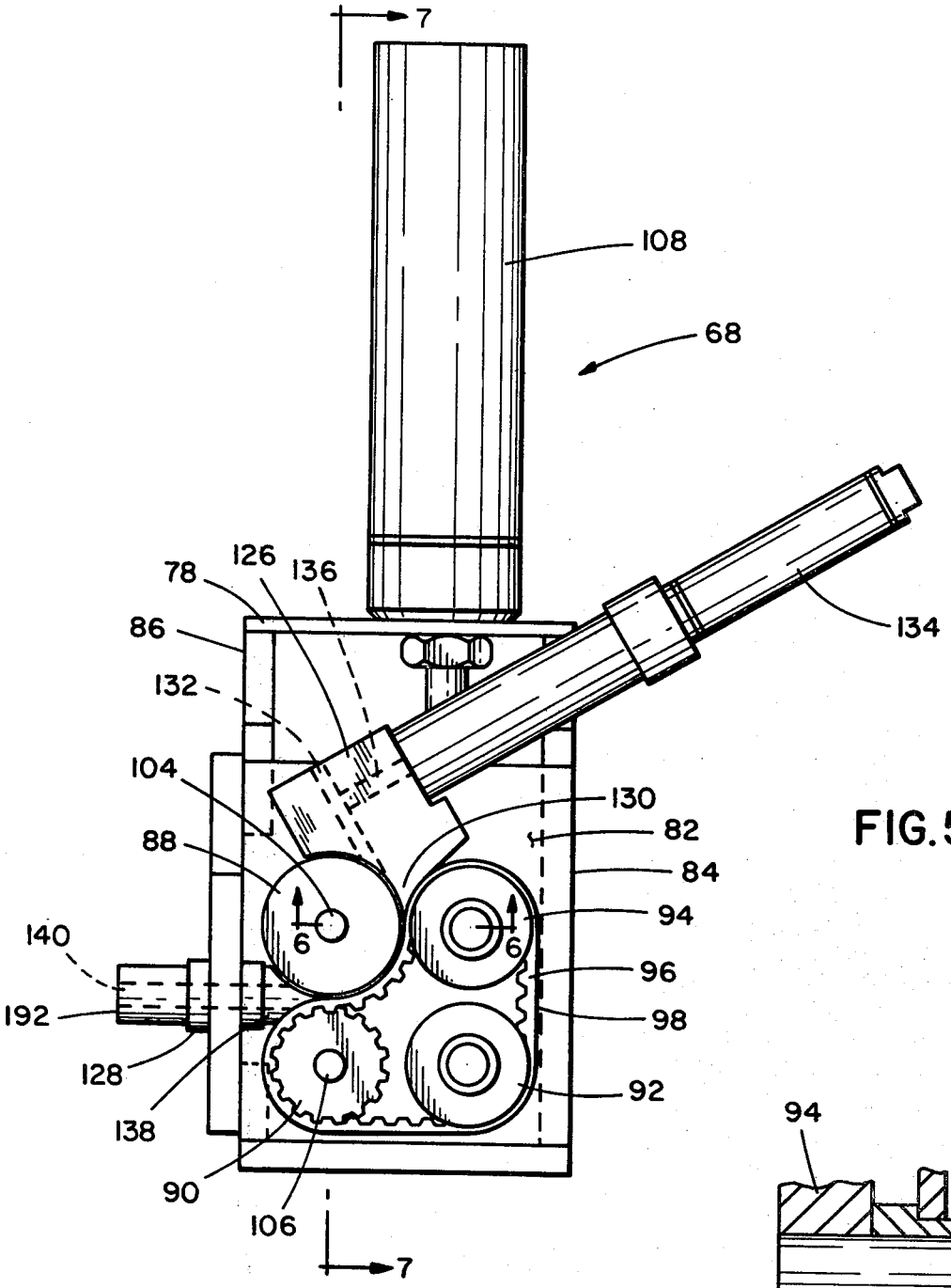
FIG. 5 is a back elevational view of the feeder showing means for conveying the tubing.

The tubing conveying means, best shown in FIG. 5, comprises a feeder roller 88, a toothed drive pulley 90, an idler pulley 92, and a guide pulley 94 all suitable rotatably positioned adjacent back wall 82. An endless rubber conveyor belt 96 having a toothed inner surface and a generally flat outer surface 99 is trained around the pulleys with a portion of outer surface 98 engaging feed roller 88.

Figure 6:
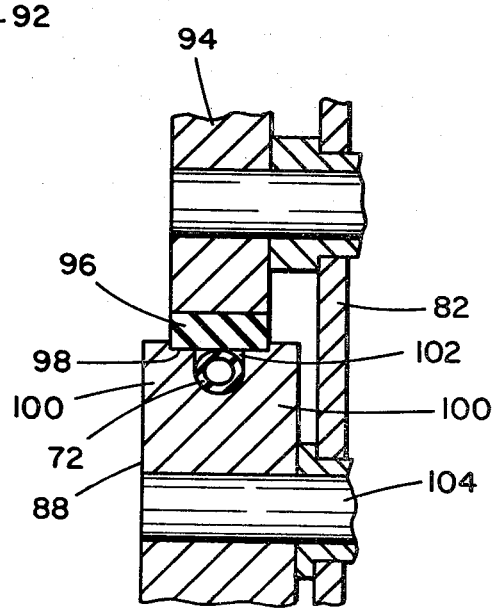
FIG. 6 is a partial sectional view generally along line 6—6 of FIG. 5 showing the conveyor means compressively holding the tubing.

As shown in FIG. 6, feed roller 88 includes a pair of spaced annular shoulders 100 engaging the outer belt surface 98 and further includes a circular tubing-receiving slot 102 separating the shoulders. As shown in FIG. 6, the spacing between the belt and the bottom of slot 102 is slightly less than the outside diameter of the tubing so that the tubing is slightly compressed to insure good frictional engagement among the tubing, feed roller, and belt as is required for positive feeding of the tubing. However, the relative positions of the belt and slot do not result in substantial flattening of the tubing. It should be noted that relative to the sleeve installer 70, the tubing is being pushed as opposed to being pulled. As the tubing is not substantially flattened by the tubing conveying means, it retains sufficient column strength to prevent buckling as it is fed into the sleeve installer 70. Feed roller 88 and drive pulley 90 are mounted on respective shafts 104, 106 extending between and suitably journaled to back wall 82 and front wall 80. Both roller 88 and pulley 90 are driven as will appear hereinafter. The positioning of idler pulley 92, as will readily be understood by those skilled in the art, can be varied relative to feed roller 88 to provide a tension adjustment for conveyor belt 96.

Figure 7:
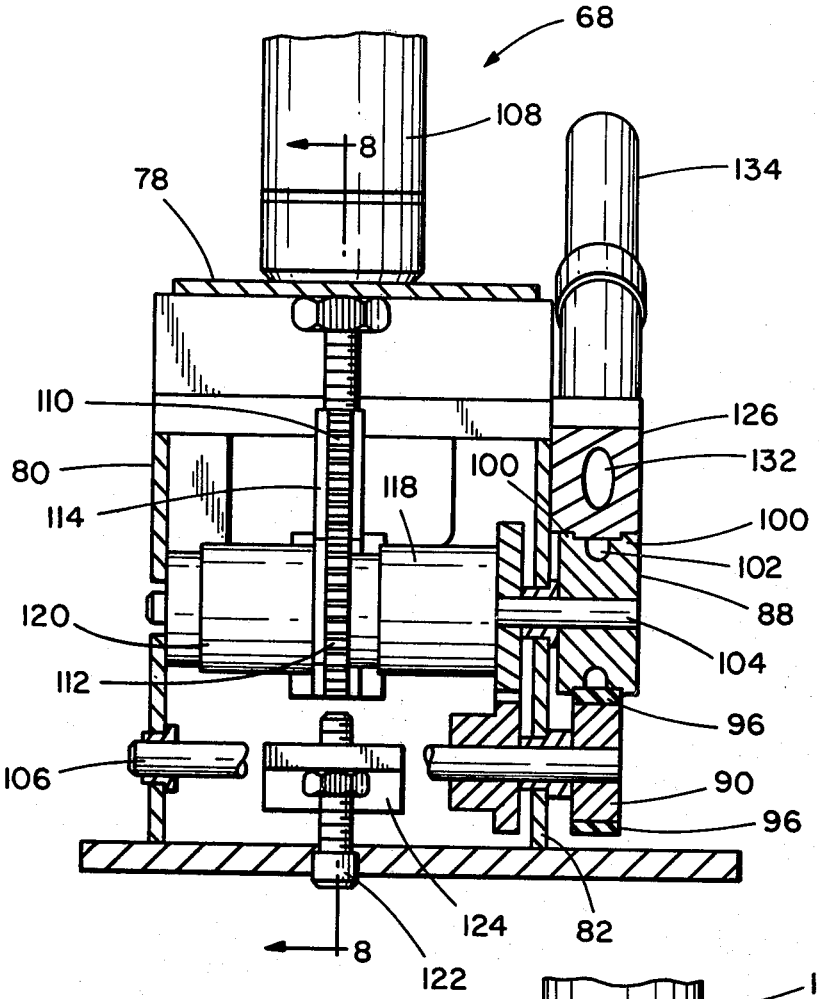
FIG. 7 is a sectional view generally along line 7—7 on FIG. 5 showing unidirectional drive means for driving the tubing conveyor means.
Figure 8:
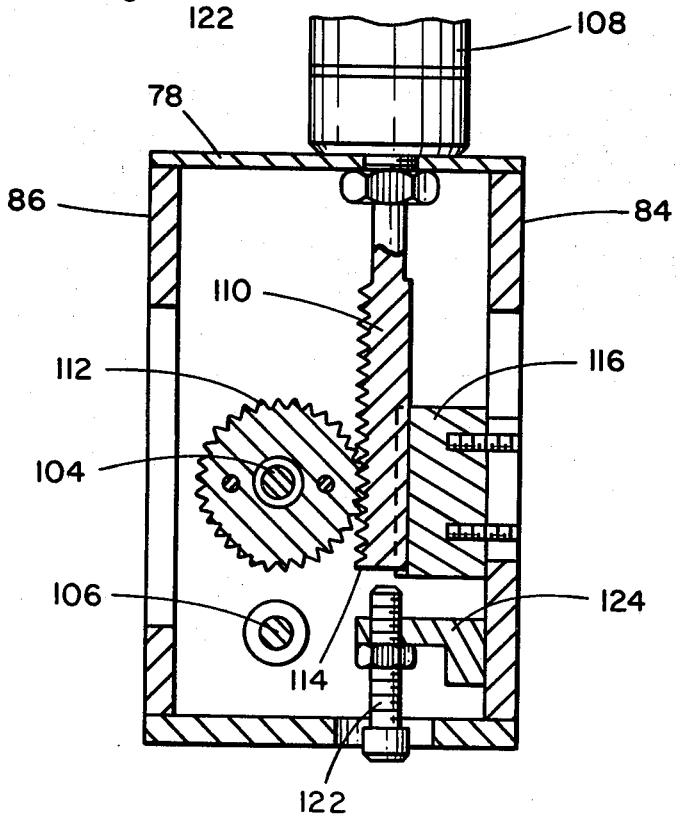
FIG. 8 is a sectional view generally along line 8—8 of FIG. 7 showing a rack and pinion gear arrangement used in conjunction with the unidirectional drive means.

Referring to FIGS. 7 and 8, the unidirectional drive means of feeder 68 comprises a drive cylinder 108 carried by top wall 78. Cylinder 108 reciprocates a rack 110 engaging a pinion gear 112 which is concentric with feed roller shaft 104. Rack 110 is carried by an elongate support 114 connected to the rod of cylinder 108 and guided for reciprocating movement by a guide block 116 affixed to side wall 84. The drive means also comprises a pair of one-way clutches 118, 120, also concentric with feed roller shaft 104, clutch 118 being disposed between gear 112 and back wall 82 while clutch 120 is positioned between the gear and front wall 80. An example of such one-way clutches is Model PSI manufactured by Warner Electric Corporation. Clutch 118 is of the right-hand or clockwise rotation type and has its drive half connected to gear 112 and its driven half connected to feed roller shaft 104. With reference to the FIG. 5 orientation of feed roller 88, as drive cylinder 108 extends its rod causing the rack 110 to rotate gear 112 in the clockwise direction, clutch 118 imparts clockwise rotation to feed roller 88. The clutch 118 slips when cylinder 108 retracts its rod causing rack 110 to rotate gear 112 in the clockwise direction. One-way clutch 120 is of the left-hand or counterclockwise rotation type and has its drive half connected to feed roller shaft 104 and its driven half fixedly held by feeder frame front wall 80. Thus, shaft 104 cannot rotate in a counterclockwise direction since the driven half of clutch 120 is held from rotation by the frame whereby retrograde feeding of the tubing is positively prevented. Of course, clutch 120 slips when its drive half rotates clockwise. It is noted that the driven half of clutch 118 can freewheel. This allows convenient initial threading of the tubing into the tubing-conveying means as by manually moving conveyor belt 96 so that the feed roller rotates in the clockwise direction.

The unidirectional drive means also comprises an adjustment bolt 122 threadedly held by a support block 124 carried by back wall 84. The end of bolt 122 is engageable with rack support 114 and serves to limit the stroke of drive cylinder 108. Thus by adjustment of bolt 122, the length of tubing conveyed during one stroke of the drive cylinder can be varied.

Referring to FIG. 5, feeder 68 also includes a tubing input guide 126 and a tubing output guide 128. Guide 126 includes a nose portion 130 extending between feed roller 88 and belt 96 and further includes a bore 132 directing the tubing into slot 102 of the feed roller. Guide 126 also carries the means for compressing the tubing in the form of a pinch cylinder 134 and also has an aperture 136 communicating with bore 132 for receiving the rod of cylinder 134 as it extends to form an airtight seal in the tubing. Similarly, guide 128 includes a nose portion 138 extending between the feed roller and the belt. A bore 140 receives the tubing from feed roller slot 102 and directs it into the sleeve installer 70.

Sleeve installer 70, shown in FIGS. 9, 10 and 14–17, includes sealing means for providing a seal near the end of a tubing inserted into the sleeve installer; expansion means for radially expanding sleeve 60 along non-parallel planes sufficiently to receive connector 62 by introducing pressurized fluid into the tubing between the sealing means of the sleeve installer and the point at which the tubing is sealed in the feeder 68; holding means for maintaining the portion of tubing including sleeve 60 in its expanded condition after the application of fluid pressure into the tubing has terminated and for permitting connector 62 to be received, terminal end portion 58 first, into the expanded sleeve; cutter means for severing the expanded portion or sleeve to be installed from the remainder of the tubing; and release means operable to release the sleeve from its expanded condition after a connector 62 has been inserted into the sleeve installer. The sleeve installer 70 comprises an elongate housing 142 carrying an expansion chamber (plastic shell) 144 for receiving the tubing. Housing 142 is made of an electrically conductive material such as aluminum and an end cap 143 for the housing is made of an electrically insulating material such as plastic.

Sleeve installer 70 includes an electrically conductive shear tube 148, best shown in FIGS. 12 and 13, having a sharpened end 150 and four, spaced longitudinally extending flutes or grooves 152 on the outer surface thereof which terminate short of the sharpened end of the tube. The holding means includes the body of tube 148 while the cutter means includes the sharpened end 150 of the tube. Shear tube 148 is movable between a holding position, see FIG. 9, wherein it extends into expansion chamber 144 and a release position, shown in FIG. 14, wherein the tube is withdrawn from the expansion chamber.

Referring to FIG. 11, the expansion means of sleeve installer 70 comprises a generally cylindrical electrically conductive arbor 154 for being received within the leading portion of tubing 72 as it is fed into installer 70. Arbor 154 includes a stop 155 for abutting against the end of the tubing and further includes an axial fluid passageway 156. A sleeve 157 of a synthetic resinous polymer such as polytetrafluoroethylene is disposed about a portion of the arbor but terminates short of the tubing-receiving end of the arbor to provide a low friction surface for sliding engagement with the tubing. Spaced apertures 158 extend through arbor 154 and sleeve 157 to permit entrance of pressurized fluid into the tubing. Arbor 154 includes a restrictor 160 at one end thereof for causing a dynamic pressure differential as will appear more fully hereinafter. The arbor 154 is movable between an expansion position, shown in FIGS. 14 15, and 16 wherein the arbor extends into expansion chamber 144 and inside the end of the length of tubing 72 and a second position, shown in FIGS. 9, 10, and 17, wherein the arbor is retracted from the expansion chamber.

More specifically, housing 142 includes a pair of coaxial, longitudinally spaced piston chambers 162, 164 coaxial with expansion chamber 144 and separated by a spacer 165. Arbor 154 is part of an arbor assembly 153, see FIG. 11, which further comprises an electrically insulative arbor piston 166 slidably disposed in chamber 162 and connected to an electrically insulative arbor base 168 which in turn holds arbor 154 in electrical isolation from housing 142. Suitable ports P1, P2 are provided on either side of piston 166 and a high pressure port P3 communicates with arbor air passageway 156 via an electrically conductive high pressure inlet tube 167 press fit into port P3.

A shear tube piston 170, slidably disposed in chamber 164, carries the shear tube 148 which is concentric with and slidably relative to arbor base 168. Ports P4 and P5 are provided on either side of piston 170 which is part of the release means operable to release sleeve 60 from its expanded condition.

Figure 9:
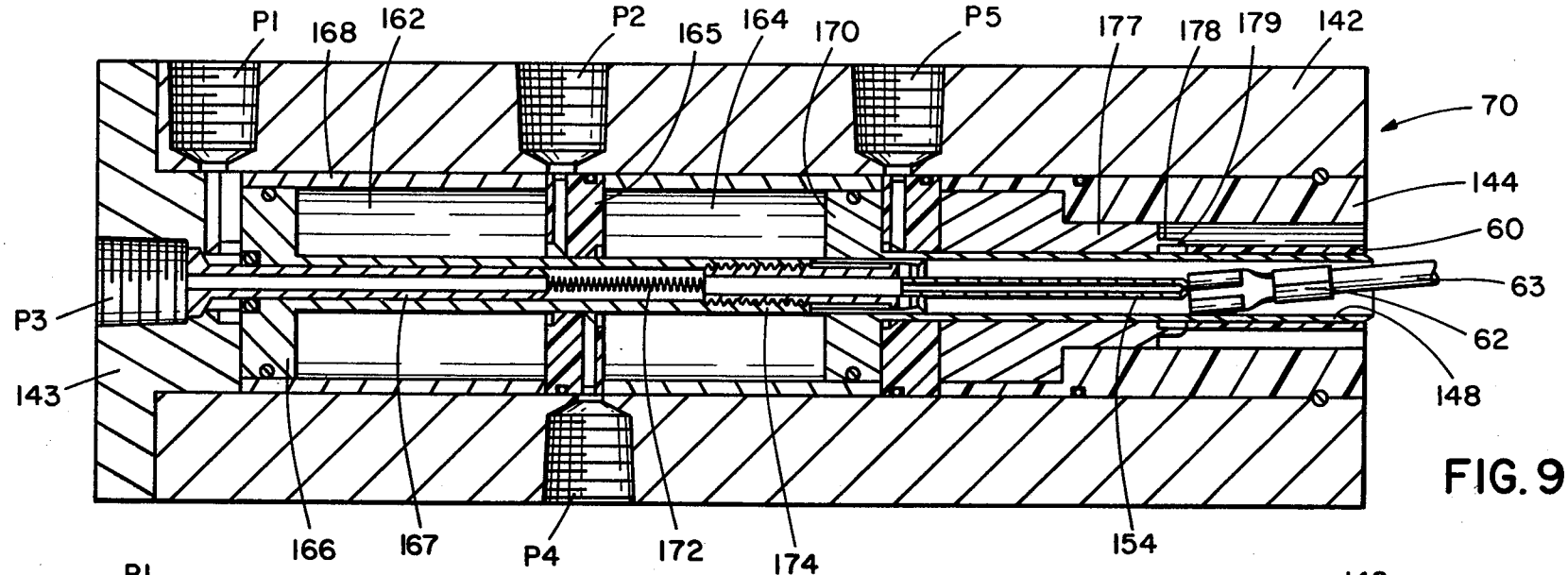
FIG. 9 is a cross-sectional view of the sleeve installer, including a shear tube and tube mandrel carrying an arbor, both independently movable between extended and retracted positions, showing the shear tube extended and holding an expanded insulated sleeve.

An electrically conductive coil spring 172 connects arbor 154 and inlet tube 167. It should be noted that shear tube 148, through metallic piston 170, forms an electrically conductive path to housing 142. The inside diameter of shear tube 148 is slightly larger than the connector 62 to be insulated; however, when the connector is disposed inside the shear tube, it will make contact at some point with the inner surface of the tube. Referring to FIG. 9, when the connector, inserted in the shear tube 148, engages the end or arbor 154, an electrically conductive path is formed from housing 142 to inlet tube 167. As will be discussed more fully hereafter, the apparatus of the present invention includes a circuit responsive to proper positioning of the connector, i.e. the connector simultaneously touching the arbor and the tube, to retract the shear tube thereby permitting the expanded insulating sleeve to contract about the connector.

Arbor 154 with sleeve 157 disposed thereabout has an outside diameter smaller than the inside diameter of the tubing in its stable or non-expanded condition. Stable or non-expanded condition is defined to mean the condition of the tubing when not acted upon by outside forces whereas unstable or expanded condition indicates that the inside diameter of the tubing is larger than in its stable condition and the tubing is acted upon by outside forces; e.g. greater pressure is applied inside the tubing or the tubing is mechanically held, and due to its resiliency will return toward its stable condition when application of the outside force is terminated. The sealing means of the sleeve installer 70 comprises a generally circular first sealing lip 174 carried by arbor base 168 and extending into expansion chamber 144 when arbor 154 is in its expansion position. Lip 174 has a radial inwardly extending annular projection 176 including an annular ramp surface 177 sloping inwardly toward stop 155 for engaging and starting the end of tubing 72 to fold in on itself when fluid pressure is applied inside the tubing. Projection 176 is concentric with arbor 154 and has an inside diameter substantially equal to the outside diameter of the tubing in its stable condition with the spacing between projection 176 and the sleeved arbor 154 slightly greater than the wall thickness of the tubing in its stable condition. Lip 174 and arbor 154 define a well for receiving the end of the tubing as it is fed into the expansion chamber.

Figure 15:
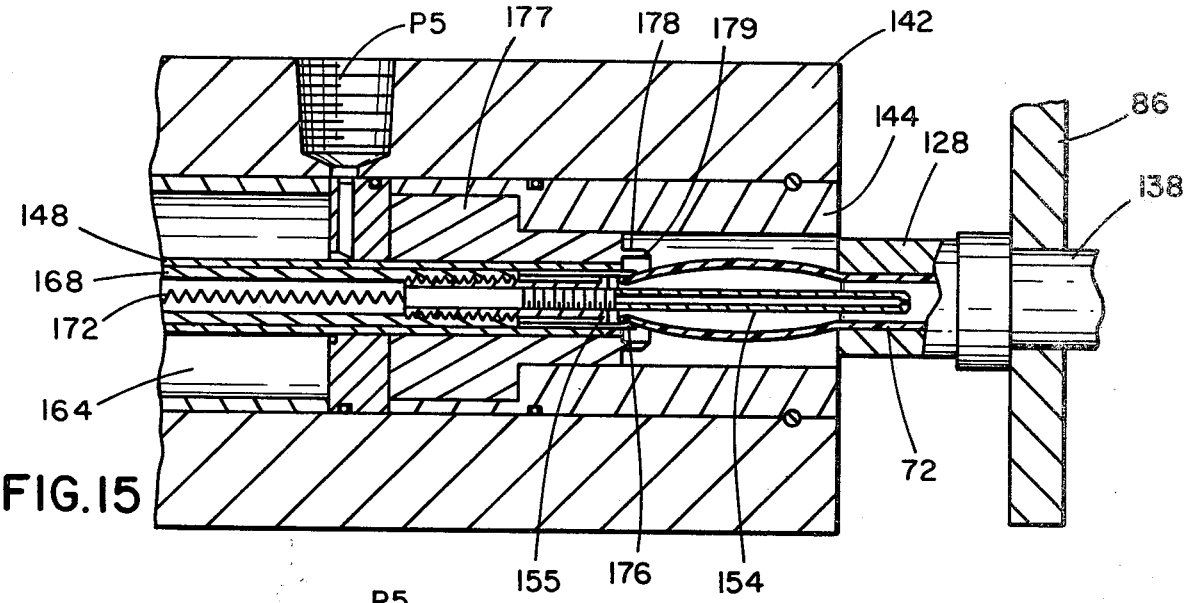
FIG. 15, similar to FIG. 14, shows the tubing starting to expand with the outside surface of the tubing engaging a first annular seal carried with the arbor.
Figure 16:
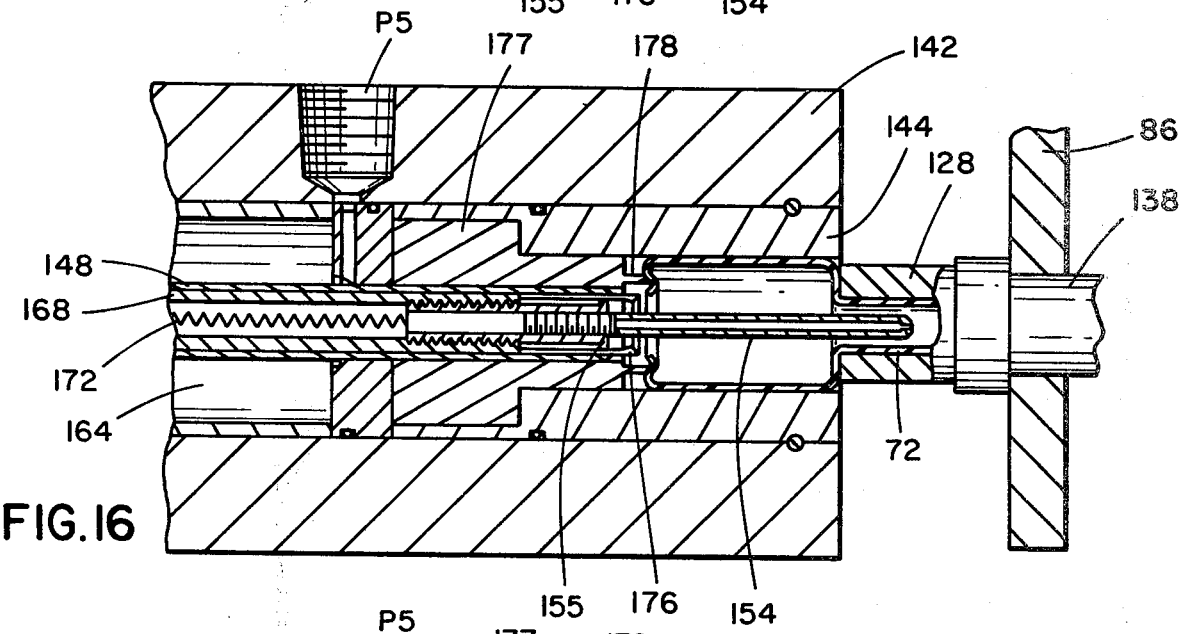
FIG. 16, similar to FIG. 15, shows the tubing fully expanded with the outside surface of the tubing engaging a second and fixed seal.
Figure 17:
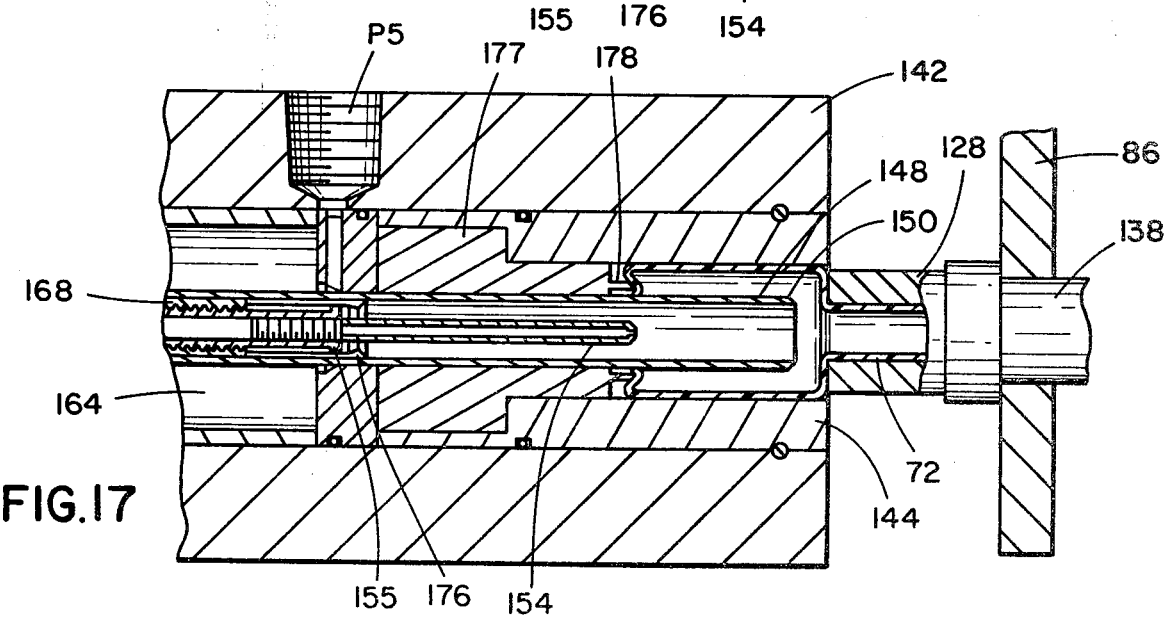
FIG. 17, similar to FIG. 16, shows the shear tube extending to sever the expanded sleeve from the remainder of the length of tubing.

The sleeve installer sealing means also comprises a fixed second generally circular sealing lip 178 concentric with first lip 174 and extending into expansion chamber 144 from a support 177. Lip 178 includes an annular ramp surface 179 inclined outwardly relative to stop 155 for engaging the end of the tubing when the leading portion thereof is fully expanded. Lip 178 has a greater inside diameter than the outside diameter of shear tube 148 and extends further into the expansion chamber 144 than first lip 174. Referring to FIG. 15, when the rod of pinch cylinder 134 is extended to form a seal in the tubing in the feeder and pressurized air enters the tubing via passageway 156 and apertures 158, initially the pressure in the tubing on the sleeve installer side of the restrictor is greater than in the tubing on the feeder side of the restrictor due to the pesence of restrictor 160. This causes the leading portion of the tubing to bulge so that it engages surface 177 of lip 174 to form a generally airtight seal. With continued application of pressure, the tubing between projection 176 and restrictor 160 continues to expand toward the inner surface of expansion chamber 144. The outside surface of the tubing end portion slides on surface 177, folds itself inwardly due to the presence of fixed lip 178, and engages and slides on surface 179. The tubing end portion continues its sliding action relative to respective surfaces 177, 179 of lips 176, 178 until it disengages lip 176 and moves to its fully expanded condition engaging surface 179 as shown in FIG. 16. As shown in FIG. 17 with the leading end of the tubing fully expanded, shear tube 148 can extend to mechanically hold and sever the sleeve 60 from the remainder of the length of tubing without substantial interference from the sealed end of the tubing. It should be appreciated that the tubing expands radially generally uniformly, as opposed to the stretching along parallel planes of the prior art, thereby avoiding high localized stress concentrations in the tubing which could cause degradation of its insulative characteristics. Lips 174 and 178 and pinch cylinder 134 constitute sealing means for providing two spaced seals in the length of radially expandable resilient insulating tubing 72.

Figure 19:
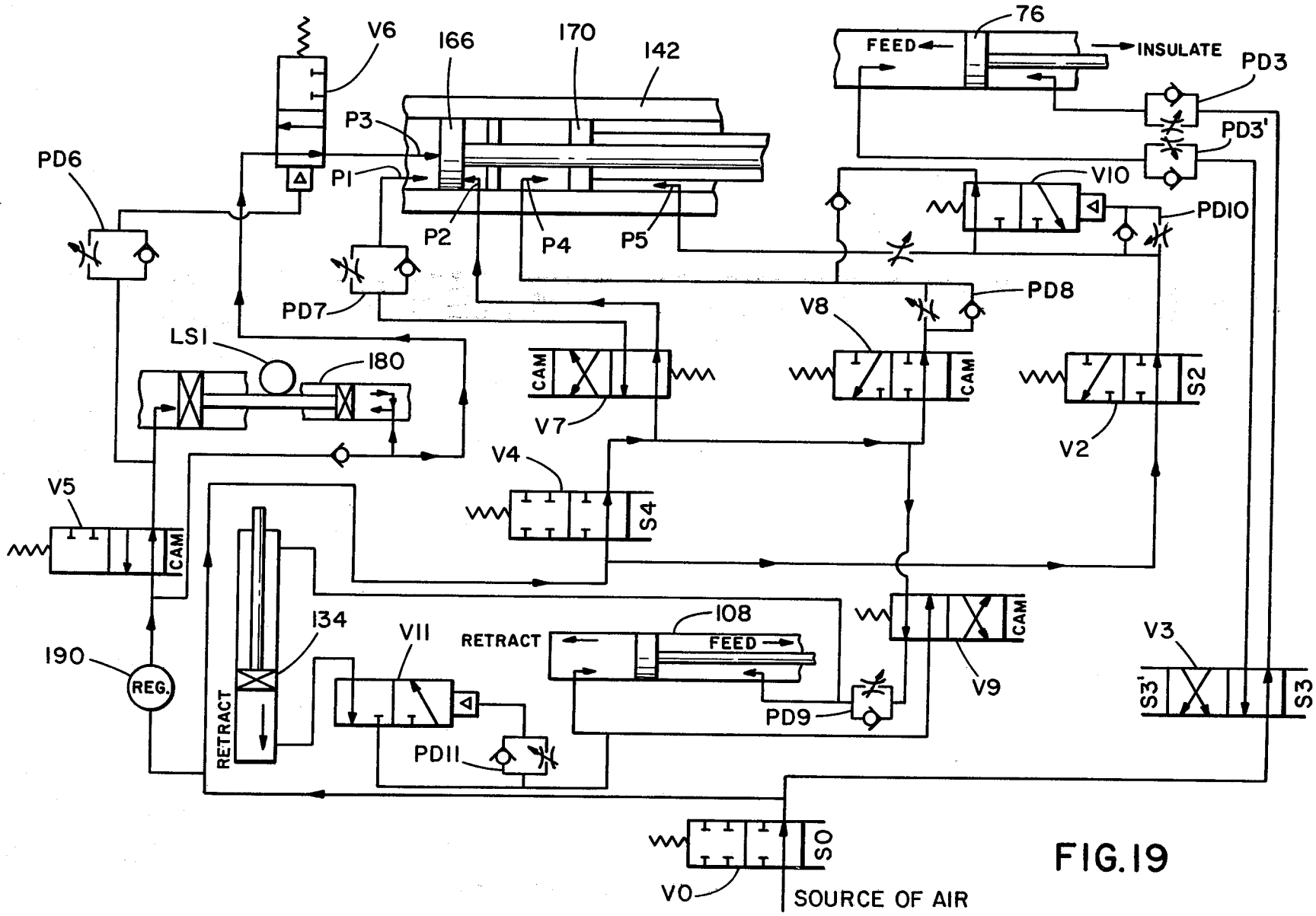
FIG. 19 is a schematic diagram of the various pneumatic components used in controlling the apparatus of the present invention.

Referring to FIG. 19, the apparatus of the present invention comprises a pneumatic control circuit including a two position normally closed solenoid operated main air supply valve VO suitably connected to a factory air supply. Valve VO supplies a double solenoid actuated four-way index conrol valve V3, a two-way normally closed solenoid operated sleeve installer air supply valve V4, and a three-way solenoid operated shear tube retract valve V2. The main air supply valve VO also is pneumatically connected to the low pressure side of an intensifier or pneumatic amplifier 180 through a regulator 190 and a two-way normally closed cam-operated control valve V5. As is known by those skilled in the art, the parallel connection of a restrictor and a check valve functions to delay the buildup of pressure so as to effect a time delay. Hereinafter, such parallel connections of restrictors and check valves will be referred to as pneumatic time delays. As shown in FIg. 19, valve V3 supplies the right side of air cylinder 76 via a pneumatic time delay PD3 and supplies the left side of the cylinder through PD3'. Valve V4 supplies air to the feed drive cylinder 108 via a four-way cam-operated control valve V9 which also supplies air to the pinch cylinder 134 through a three-way pilot controlled valve V11. Sleeve installer air supply valve V4 similarly feeds a three-way cam-operated shear tube extend control valve V8 which supplies air to port P4. Shear tube retract valve V2 supplies the pilot of a normally open time delay valve V10 also connected to port P4. Also controlled by sleeve installer air supply valve V4 is a four-way cam-operated arbor control valve V7 which selectively supplies air to ports P1 and P2. Intensifier 180 supplies high pressure air to an expansion control V6 whose pilot is operated by valve V5 through pneumatic time delay PD6.

Figure 21:
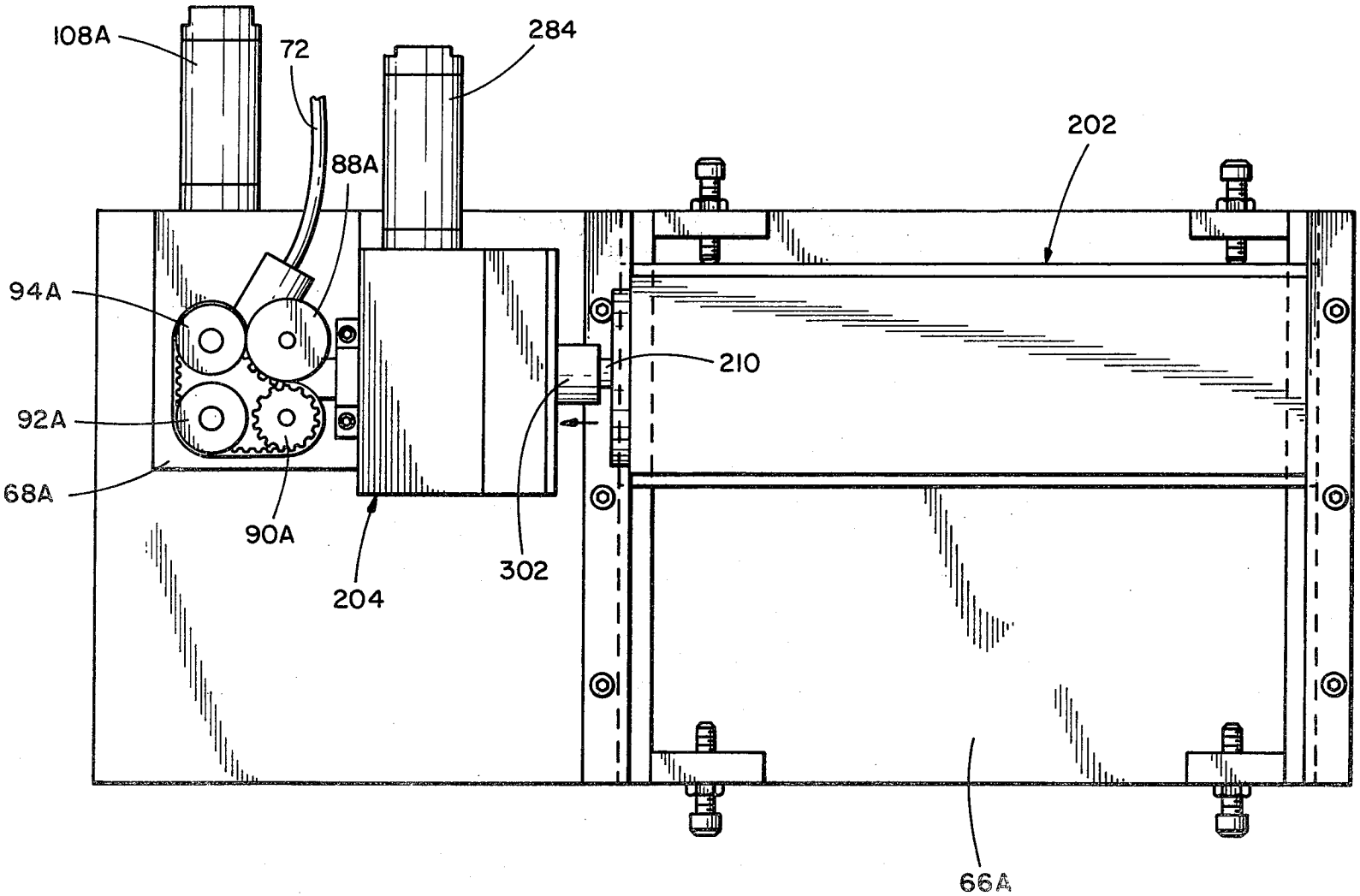
FIG. 21 is a plan of an alternate embodiment of the present invention including a tubing feeder and guide assembly and a sleeve installer and expander module showing the installer module in position to receive a sleeve from the guide assembly.

The apparatus of the present invention also comprises a sequencer or cam box 181 which selectively actuates two position valves V5, V7, V8, and V9 to move them from their respective biased positions. The cam box also selectively controls a trio of limit switches LS3, LS4, LS5 having respective sets of biased open contacts LS3-1, LS4-1, and LS5-1 connected in an electrical control circuit 182, see FIG. 18, of the apparatus of the present invention. As shown in FIG. 1, the cam box is driven by a cam box motor CBM thrugh a coupling 184 and through a clutch 183 which is controlled by a clutch solenoid S1 connected in circuit 182. The motor clutch is of the single revolution type, that is, when the cam shaft completes a 360° rotation, the clutch automatically disengages the motor shaft from the cam shaft. Also, if the solenoid S1 is deenergized at any time, the clutch automatically returns the cam shaft to its start or 0 degree position. An example of this type clutch is Model CB2 Incremental Rotation Control Package Control Package manufactured by Warner Electric Corp. The graphical representation of FIG. 21 shows the period during one 360° rotation of the cam shaft when the respective actuators of each the cam box controlled components (V5, V7, V8, V9, LS3, LS4, LS5) are engaged by the cam surface of respective cams on the cam shaft, More specifically, the upper portions of the line adjacent respective components indicates the period during which the respective component's actuator is not engaged so that the valves are in their spring-biased position or the limit switch contacts are open. On the other hand, the lower portion of each respective line indicates the period when the valves are moved from their biased positions or the period during which the limit switch contacts are closed.

Figure 18:
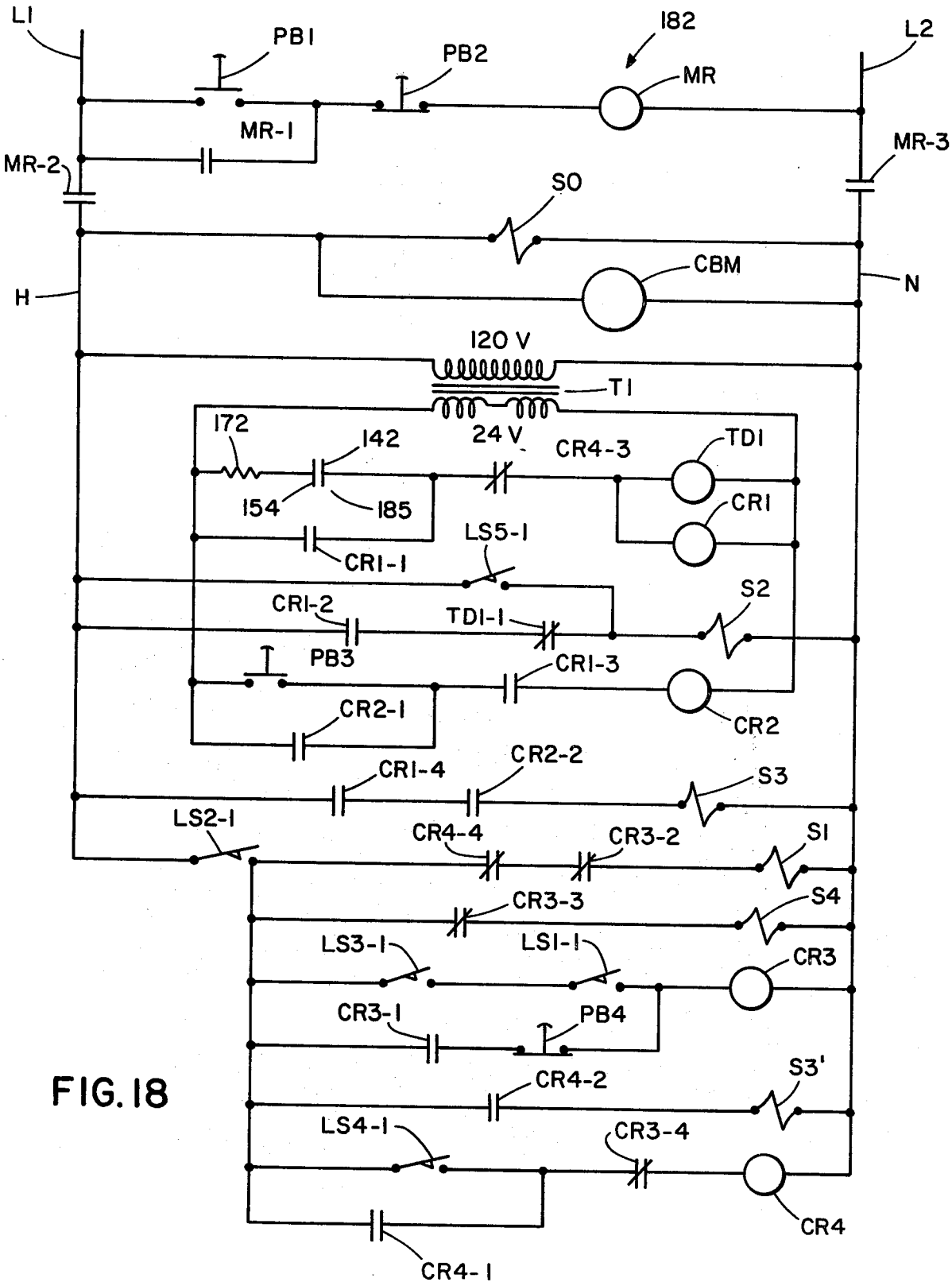
FIG. 18 is a schematic diagram of the various electrical components used in controlling the apparatus of the present invention.

Operation of the apparatus of the present invention is as follows: It is assumed that the sleeve installer 70 is initially in its connector-receiving position as shown in FIG. 2 with arbor 154 retracted and shear tube 148 extending into expansion chamber 144 and holding expanded insulating sleeve 60 as shown in FIg. 9. Referring to FIG. 18, when a start pushbutton PB1 is depressed, the coil of a motor relay MR is energized causing shunting of PB1 and connection of the hot side H and neutral side N of control circuit 182 to leads L1, L2 of a standard 110–120 volt alternating current power supply. A normally closed emergency stop pushbutton PB2 is serially connected with relay MR to drop out the relay and deenergize circuit 182. With leads H, N connected to the AC power supply, the cam box motor CBM starts (clutch solenoid S1 is not yet energized so the cam box shaft is disengaged from the motor shaft); solenoid.SO shifts master air supply VO to its open position; and the primary winding of a 5:1 stepdown transformer T1 is energized.

Figure 10:
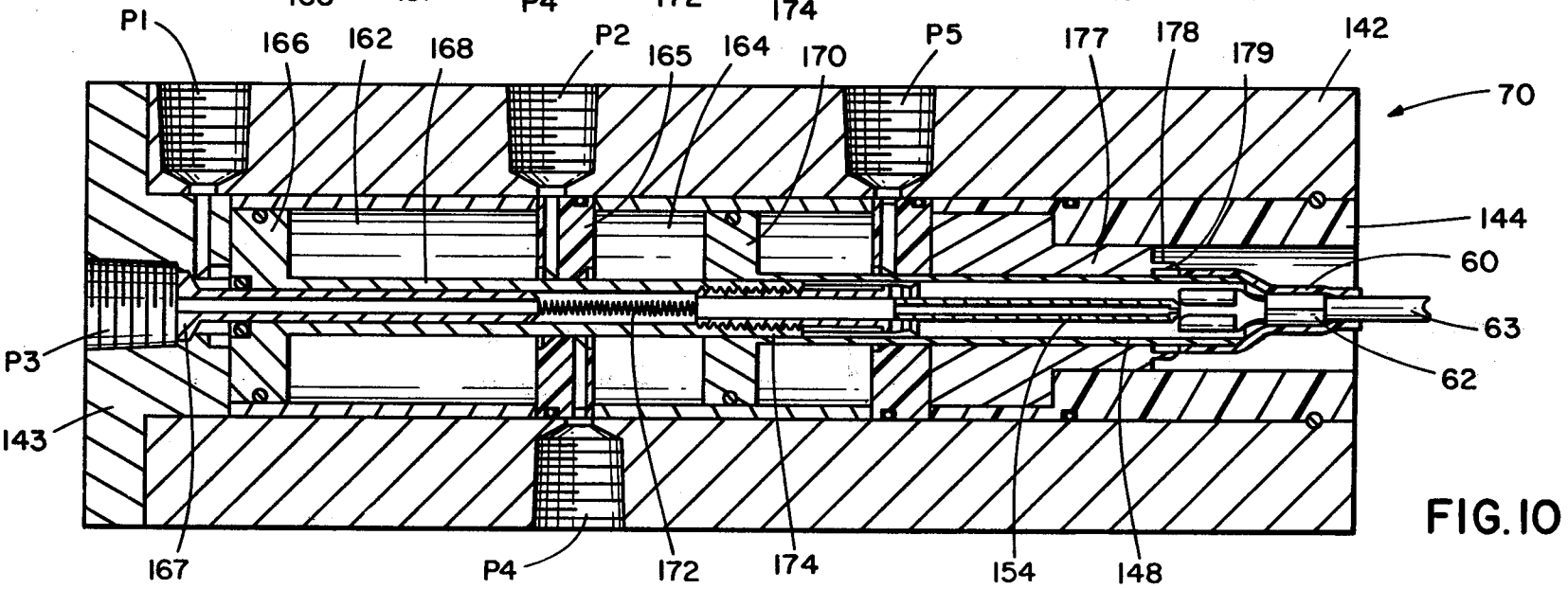
FIG. 10, similar to FIG. 9, shows the shear tube retracting thereby releasing the sleeve to contract about a terminal positioned in the sleeve installer.

The low voltage section of control circuit 182 includes spring 172 which electrically connects arbor 154 to one side of the low voltage winding of transformer T1. Arbor 154 and sleeve installer housing 142 (electrically connected to shear tube 148) are schematically shown as a set of normaly open contacts 185. Of course, the arbor and housing are connected in the low voltage section of the control circuit to preclude any possibility of electrical shock to the operator as he inserts the connector, terminal end portion first, into the sleeve installer. Upon insertion of connector 62 into shear tube 148 until the terminal end of the connector engages arbor 154, contacts 185 can be considered to close energizing the respective coils of a control relay CR1 and a time delay relay TD1. This causes contacts CR1-2 of relay Cr1 to energize solenoid S2 of valve V2 through the normally closed, timed to open contacts TD1-1 of relay TD1. Referring to the pneumatic schematic diagram of FIG. 19, when valve V2 moves to its solenoid-energized position, pressurized air is supplied to the right side of the shear tube piston 170 via port P5. Pressurized air from V2 is also supplied through normally open valve V10 to the left side of piston 170 via port P4. Valve V2 also supplies air to the pilot of V10 through pneumatic time delay PD10. Thus, valve V10 is connected as a normally-open time-to-close valve. With air supplied to both sides of the shear tube piston, the piston is held stationary. Additionally, air from port P5 excapes by flowing down the grooves 152 of the shear tube underneath sleeve 60. This causes the sleeve 60 to further expand slightly and lift off the outside surface of the shear tube 148. After valve V10 closes, the shear tube moves towards its release position and sleeve 60 is free to contract about connector 62 and the portion of the wire 63 adjacent the connector as shown in FIG. 10. It is noted that as there is no requirement that the insulated wire 63 have a smaller outside diameter than the inside diameter of the tubing in its stable condition, as was the case in prior art mechanical sleeve installers wherein the wire was inserted through the sleeve before stretching; the contracted sleeve can compressively hold both terminal 62 and wire 63. The insulated connector may then be conveniently removed from the sleeve installer. It is noted that the time delay of relay TD1 is longer than the time delay associated with valve V2. When contacts TD1 open, solenoid S2 is deenergized and application of air to the right side of the shear tube piston 170 terminates. Thus, the low voltage section of circuit 172 includes means, comprising relays CR2, TD1, solenoid S2 and spring 172, responsive to positioning of terminal 62 in expansion chamber 144 to actuate the release means to permit the sleeve to contract about the connector.

The low voltage section of control circuit 182 also comprises a sleeve load cycle initiation pushbutton PB3 which, when depressed, causes energization though closed contacts CR1-3 of control relay CR2, which has a first set of normally open contacts CR2-1 shunting PB3 for sealing in the CR2 coil. Relay CR2 has a second set of normally open contacts CR2-2 connected in seriatim with contacts CR1-4 and solenoid S3 of index valve V3 across the AC source. Of course, PB3 could be replaced by a sensor responsive to withdrawal of the insulated terminal from the expansion chamber to initiate indexing of the sleeve installer without operator action.

Referring to FIG. 19, energization of solenoid S3 causes valve V3 to move in position to supply air to the right side of the piston of index air cylinder 76. This causes turntable 74 to rotate and carry sleeve installer toward its tubing-receiving position, shown in FIG. 1, wherein expansion chamber 144 is aligned with feeder output guide 128.

Worktable 66 carries a limit switch LS2 having a wiper arm suitably positioned to close contacts LS2-1 upon alignment of the sleeve installer with the feeder. The closing of contacts LS2-1 causes energization of both clutch solenoid S1 which starts rotation of the cam box shaft and solenoid S4 of sleeve installer air supply valve V4 causing V4 to shift to its open position wherein it supplies air to feeder valve V9 (positioned to insure the respective rods of feed drive cylinder 108 and pinch cylinder 134 are retracted), arbor valve V7 (positioned to supply air to port P2), and shear tube extend valve V8 (in its closed position).

Figure 20:
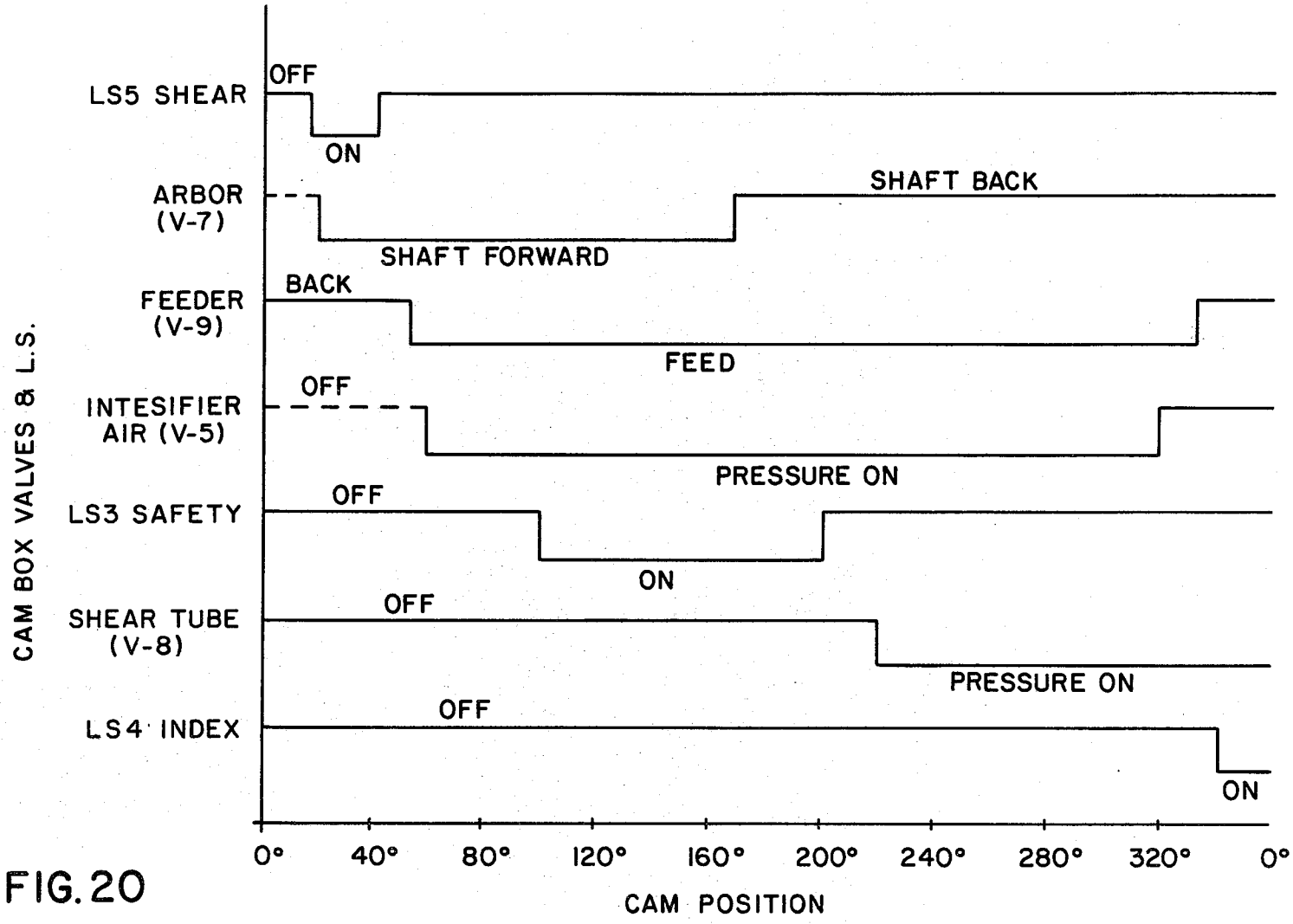
FIG. 20 is a graphical representation of the operation of a sequencer used in conjunction with the present invention showing the duration of on time and off time of the various components during one cycle of operation of the sequencer.

Referring to FIG. 20, operation of the cam box is as follows: Contacts LS5-1 are closed energizing solenoid S2 of shear tube retract valve V2 which shifts to its open position supplying air to port P5 to hold the shear tube in its retracted position. The cam box next moves arbor valve V7 to supply air to arbor piston 166 via pneumatic time delay PD7 and port P1 causing the arbor to move to its extended or expansion position. It is noted that the time delay from closure of contacts LS5-1 until the cam box next actuates V7 plus the delay of PD7 is significantly longer than the time delay associated with valve V10. Accordingly, the action of V10 at this stage of operation of apparatus 64 is inconsequential. contacts LS5-1 are allowed to open dropping out solenoid S2 allowing valve V2 to close. Feeder valve V9 is next shifted to supply air to the left side of the drive cylinder 108 piston causing the cylinder to drive the tubing-conveying means. As previously noted, the stroke of cylindr 108 is adjustable to insure that at the completion of its stroke, the end of the tubing is disposed in expansion chamber 144 between annular projection 176 of first sealing lip 174 and arbor 154. Feeder valve V9 also transmits air to pinch cylinder valve V11 and its pilot, the latter via pneumatic time delay PD11 which provides a delay of greater duration than the time required for drive cylinder 108 to complete its stroke. Accordingly, after the feeding of tubing into expansion chamber 144 has been completed, valve V11 shifts causing pinch cylinder 134 to extend its rod forming a seal in the tubing in the feeder 68.

The cam box next shifts valve V5 to supply air via regulator 190 to the low pressure side of intensifier or pneumatic amplifier 180, the output of which is connected to normally closed tubing expansion valve V6. Regulator 190, of course, functions to produce a constant input pressure to valve V5 so that the output pressure of the intensifier is of sufficient magnitude to inflate the tubing. The output pressure of the inensifier is an exemplary 150 pounds per square inch. The output of valve V5 also supplies the pilot of valve V6 through a pneumatic time delay PD6 having a sufficient delay to insure pressurization of the intensifier 180 before valve V6 is switched to its open position, Referring to FIGS. 14 and 15, when valve V6 switches to its open position, high pressure air enters the tubing disposed in expansion chamber 144 via port P3, air passageway 156, and arbor apertures 158 to inflate the tubing, as previously described, until the tubing is disposed with its end engaging fixed second sealing lip 178 as shown in FIg. 16.

Intensifier 180 carries a normally open limit switch LS1 suitably positioned to close its contacts LS1-1 (see FIG. 18) in response to the intensifier piston reaching the end of its travel as it would if the tubing did not inflate. The cam box next closes contacts LS3-1 which is series-connected with contacts LS1-1 and the coil of a control relay CR3 across the electrical potential source. If contacts LS1 are closed when the cam box switches LS3, it indicates the tubing was defective and failed to inflate. Relay CR3 has a first set of normally closed contacts CR3-1 disposed in series with reset pushbutton PB4 across contacts LS3 and LS1 for sealing in the coil of CR3 and further has three sets of normally closed contacts CR3-2, -3, —4, which respectively drop out clutch solenoid S1, turn off the sleeve installer air supply valve V4, and prevent energizaton of a control relay CR4 which, as will appear hereinafter, controls indexing of the sleeve installer 70 to its terminal-receiving position shown in FIG. 2. Suitable means for attracting operator attention by providing visual or audible indication of the tubing's failure to inflate can conveniently be connected in parallel with the coil of relay CR3. When clutch solenoid S1 drops out, the clutch automatically resets the cam shaft to its start position. The procedure to be followed in restarting apparatus 64 includes:

(a) depressing stop button PB2 to deenergize circuit 182;
(b) manually clearing the tubing from expansion chamber 144;
(c) realigning the sleeve installer with the feeder;
(d) depressing start button PB1 to energize circuit 182;
(e) manually moving the intensifier piston to its retracted position thus opening contacts LS1; and
(f) depressing reset button PB4 to permit energization of clutch solenoid S1.

The sequencer will then start its cycle with the closing of LS5 contacts as previously described.

Of course, the tubing will normally be without imperfections which preclude inflation. Therefore, in normal operation of apparatus 64 contacts LS1-1 will not close and although contacts LS3 close, the coil of relay CR3 will not become energized. The cam box then allows arbor valve V7 to return to its biased position wherein air is supplied to the right side of piston 166 via port P2 causing the arbor 154 to move to its retracted position as shown in FIG. 17. After contacts LS3 are opened, the cam box causes shear tube extend valve V8 to shift to its open position and supply air to the left side of piston 170 by way of port P4 and a pneumatic time delay PD8. This causes shear tube 148 to extend inside the expanded tubing in expansion chamber 144 as shown in FIG. 17. Thereafter the sharpened end 150 of the shear tube engages an abutment surface 192 of feeder 68, see FIG. 5, thereby severing insulating sleeve 60 from the remainder of length of tubing 72.

The cam box next closes valve V5 cutting off air to the low pressure side of the intensifier piston; however, as air is still applied through regulator 190 to the right side of the intensifier piston, it moves to its retracted position. As air to the pilot of valve V6 is terminated, the valve moves to its biased (closed) position. Valve V9 next returns to its biased position causing retraction of the respective rods of feed drive cylinder 108 and pinch cylinder 134. Contacts LS4-1 are closed causing energization of the coil of control relay CR4 which has sets of N.O. contacts CR4-1, CR4-2, respectively, for shunting contacts LS4-1 and for energizing solenoid S3′ of index valve V3. Relay CR4 also has respective sets of N.S. contacts CR4-3, CR4-4, for dropping out the coil of control relay CR1, thereby deenergizing solenoid S3 of valve V3, and connected to deenergize clutch solenoid S1. With solenoid S3′ energized and solenoid S3 deenergized, valve V3 applies air to the left side of the piston of index cylinder 76 causing turntable 74 to carry sleeve installer 70 to its connector-receiving position shown in FIg. 2. As the sleeve installer moves from alignment with feeder 68, contacts LS2 open deenergizing solenoids S4 of sleeve installer air supply valve V4 and control relay CR4. Sleeve installer 70 is now ready to receive another terminal 62, the operation of apparatus 64 in response to insertion to the terminal into shear tube 148 having been heretofore described.

The time required for one rotation of the cam box shaft is approximately one second or less.

A suitable resilient insulating tubing for use with apparatus 64 is silicone rubber tubing having a nominal inside diameter of 0.132 inches and a nominal wall thickness of 0.025 inches supplied by the Dow Corning Corp. The tubing is post cured for one hour at 300° F.

As a method for insulating an object such as an electrical connector or the like, the present invention includes the following steps:

(1) providing two spaced seals in a length of resiliently radially expandable insulative tubing having an inside diameter, in its stable condition, smaller than the largest cross-sectional dimension of said object;
(2) applying a pressurized fluid into the tubing between the seals until a portion of the tubing between the seals expands sufficiently to receive the object;
(3) transversely cutting the tubing between the seals while maintaining the expanded portion of the tubing in its expanded condition;
(4) inserting the object into the expanded portion; and
(5) releasing the expanded portion from its expanded condition whereby the expanded portion contracts to form an insulating sleeve about the object.

Alternate Preferred Embodiment

Figure 22:
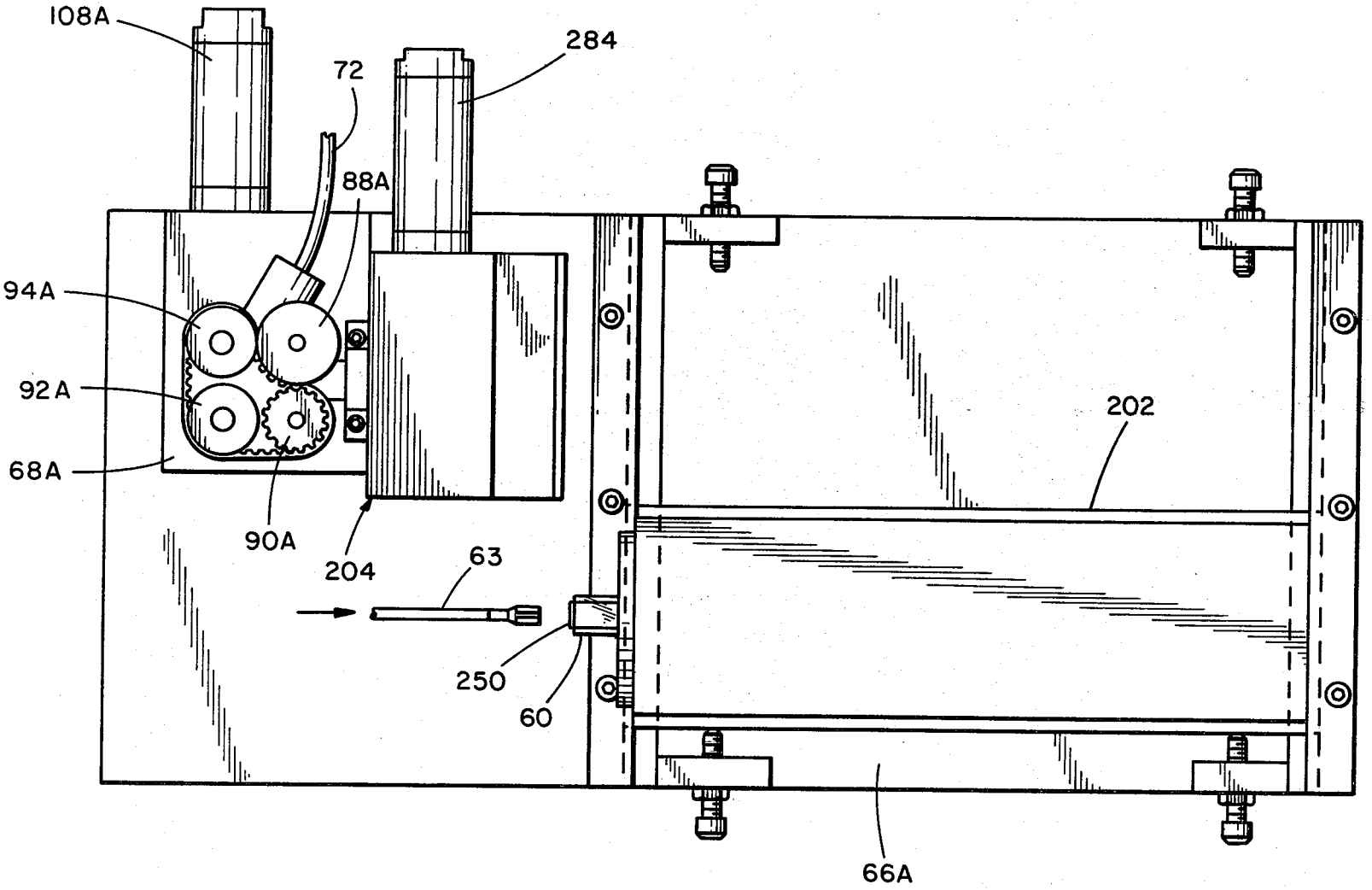
FIG. 22, similar to FIG. 21, shows the installer module holding an expanded sleeve and shows the module in position to receive a connector to be insulated.
Figure 23:
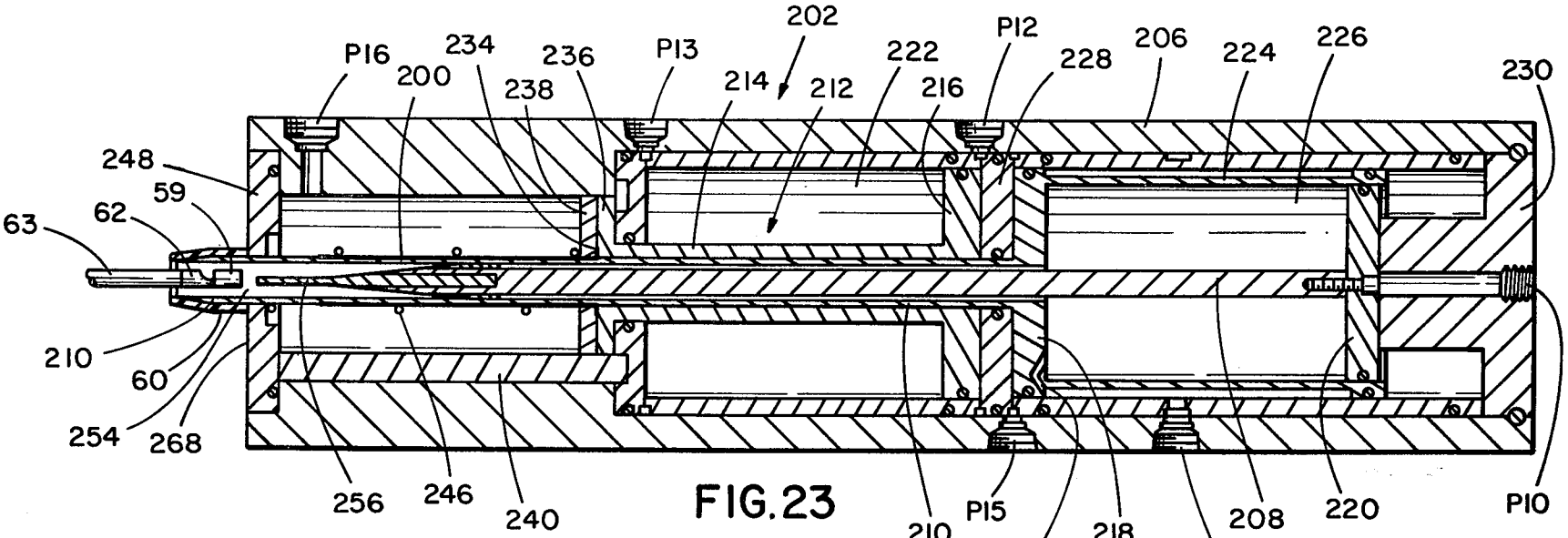
FIG. 23 is a longitudinal cross-sectional view of the installer module including an inner tube or arbor, an intermediate sleeve holding tube, and an outer wire finger carrying tube, all movable between extended and retracted positions, showing the arbor and outer tube in their retracted positions and the intermediate tube in its extended position holding an expanded insulating sleeve.
Figure 25:
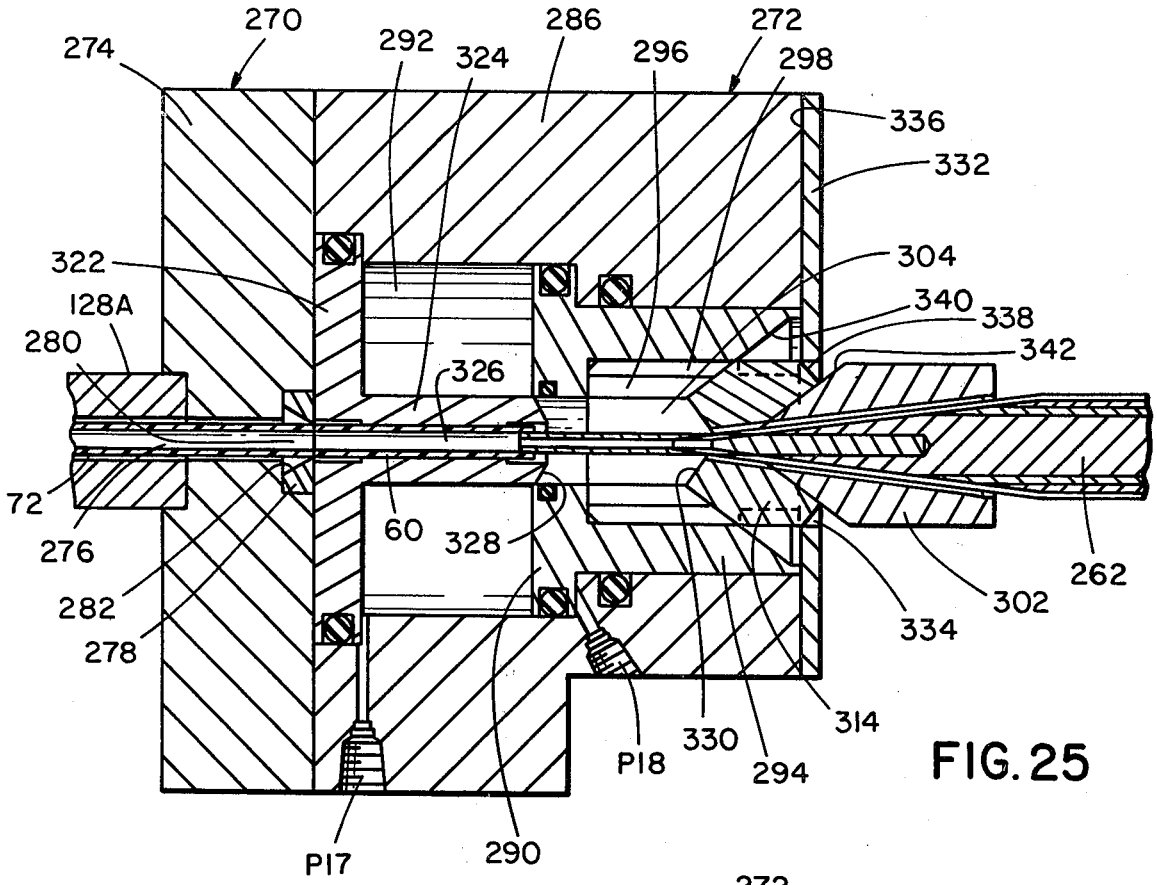
FIG. 25 is a cross-sectional view of the guide assembly, including tubing cutter means and wire finger guide means which is movable between an extended and a retracted position, showing the installer module aligned with the guide assembly, the guide means extended, and the arbor extended to a position inside the wire finger guide.
Figure 26:
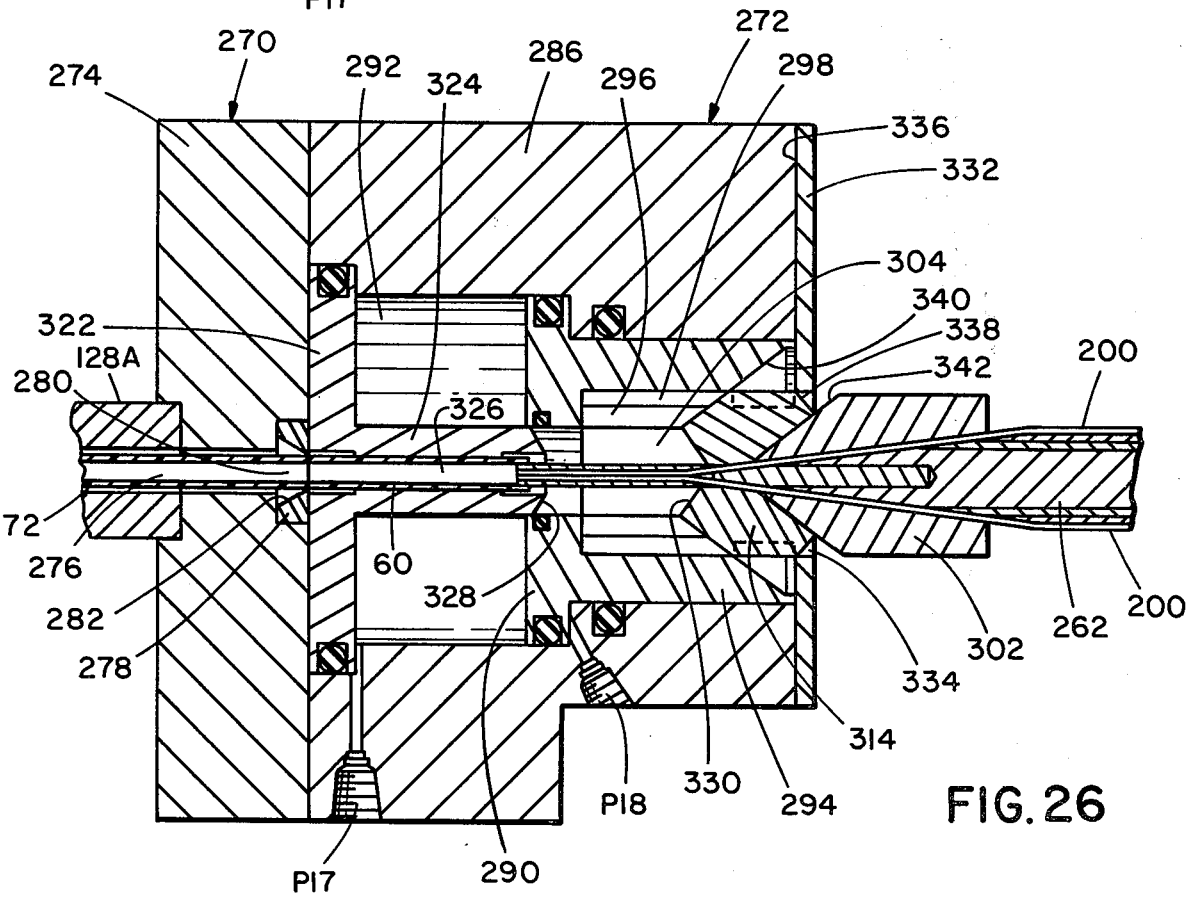
FIG. 26, similar to FIG. 25, shows the outer wire finger carrying tube extended with the wire fingers having been guided into the arbor.
Figure 33:
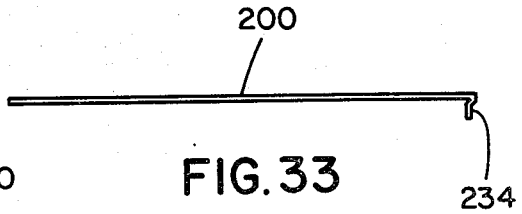
FIG. 33 is a plan of a wire finger used in the present invention.

Referring now to FIGS. 21–38, an alternate embodiment of the pesent invention is shown in which sleeve 60 is expanded by mechanical means and more specifically by a plurality of elongate flexible fingers 200, one of which is shown in FIG. 33, as opposed to expansion by introducing pressurized fluid into the tubing. Fingers 200 are laterally movable relative to one another between an insertion position, as shown in FIG. 26, in which the fingers are closely grouped to be received within sleeve 60 in its non-expanded condition and an expansion position, shown in FIG. 23, in which the fingers are spaced sufficiently to radially expand the sleeve to receive connector 62. The alternate embodiment includes a sleeve installer module 202, shown in FIG. 23, for moving the fingers to their expansion position and further includes a guide assembly 204 for guiding the fingers to their insertion position. The guide assembly includes a tubing feeder 68A similar to feeder 68 except no pinch cylinder 134 is required and the rod of a drive cylinder 108A is spring biased to return to its retracted position. Module 202 and guide assembly 204 are mounted on worktable 66A, by any suitable means to be movable relative to one another between a sleeve feeding position, see FIG. 21, wherein the sleeve installer module and the guide assembly are generally aligned and a connector reception position, see FIG. 22, wherein module 22 is spaced from guide assembly 204 and in position to receive connector 62, Sleeve installer module 202 comprises expansion means [fingers 200] for radially expanding sleeve 60 along non-parallel planes sufficiently to receive connector 62; holding means for maintaining the sleeve in its expanded condition and for permitting and the connector to be received, terminal end portion first, into the expanded sleeve; and release means for releasing the sleeve from its expanded condition and allowing it to become disposed about and compressively hold the connector. More specifically, as shown in FIG. 23, module 202 includes an elongate housing 206, an inner or arbor rod 208, an intermediate tube 210, and an outer or finger-carrying tube assembly 212 including a tube 214. Rod 208 and tubes 210, 214 are concentric and are connected to respective pistons 220, 218, and 216. Piston 216 is positioned in a chamber 222 while piston 218, having an elongate cylindrical extension 224 for receiving piston 220, is disposed in a chamber 226 longitudinally spaced from chamber 222 and separated therefrom by a divider 228. Rod 208 and tubes 210, 214 are longitudinally movable between extended positions in which the rod, tube 210, or fingers 200 extend outside housing 206 and retracted positions wherein the rod, tube 210, or fingers 200 are disposed entirely within the housing. Housing 206 includes an end cap 230 including a port P10 for supplying pressurized air to extend arbor rod 208 and intermediate tube 210. The housing also includes ports P12, P13 for introducing air to move finger-carrying tube 214 between its extended and retracted positions, a port P14 for supplying air to the left side of piston 220 through an air passageway 232 in piston 218 thereby retract piston 220, a port P15 supplying air to retract the intermediate tube 210, and a port P16 for supplying air to aid in the release of the expanded sleeve 60 as will be explained more fully hereinafter.

The expansion means comprises the plurality of fingers 200 and finger-carrying tube assembly 212 constitutes means for moving the fingers between their insertion and expansion positions. There are at least three and preferably six longitudinally extending fingers formed of wire and spaced to, in cross section, define the corners of a regular hexagon. As shown in FIG. 33, each finger 200 includes a short generally perpendicular extension 234. Referring to FIG. 23, assembly 212 includes a tube flange 236 and a cap 238 connected to flange 236 for compressively holding the respective extensions 234 of fingers 200 therebetween. The inner surface of tube 214 is hexagonal in cross section and flange 236 is slotted to receive a fixed key 240 to prevent rotation of tube 214 relative to housing 206 as well as rotation of intermediate tube 210 and arbor rod 208 which are also generally hexagonal in cross section and slidably disposed one inside of the other inside tube assembly 212.

Figure 31:
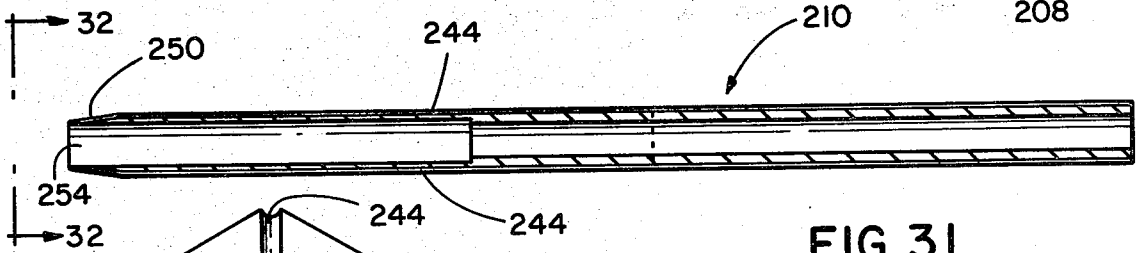
FIGS. 31 and 32 are respectively enlarged fragmentary longitudinal cross-sectional and side elevational views of intermediate tube.
Figure 32:
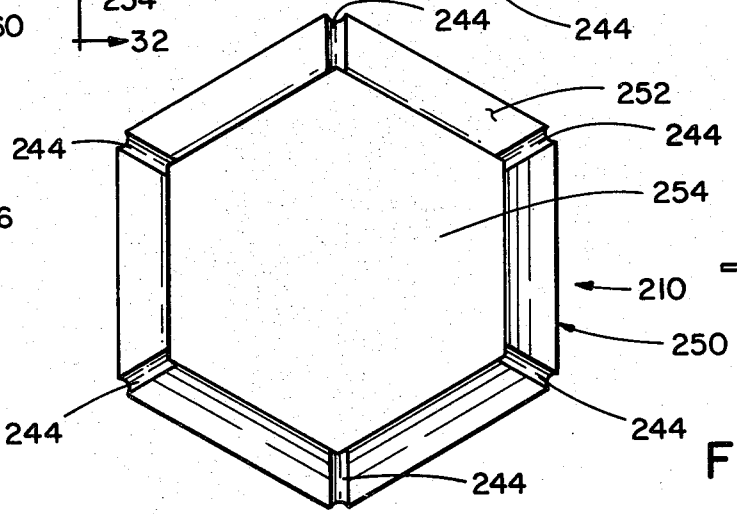

Intermediate tube 210, best shown in FIGS. 31, 32, constitutes the holding means and has an outside surface which in cross section is substantially in the form of a regular polygon having a number of sides equal to the number of fingers 200. Each corner of the outside surface of tube 210 has an elongate slot 244 for at least partially receiving and for gluiding a respective finger 200. A coiled compression spring 246, captively held between cap 238 and an end wall 248 of housing 206, serves to retain the fingers in their respective slots 244, see FIGS. 23, 24. Tube 210 also has a nose 250 having a six-sided outside ramp surface 252 sloping toward the axis of the tube in the direction of extension of fingers 200 when in their insertion position. Surface 252 acts to guide the fingers to their expansion position. Slots 244 preferably extend the length of tube 210 including nose 250. Tube 210 further includes an axial bore 254 sized to receive the connector 62.

Figure 29:
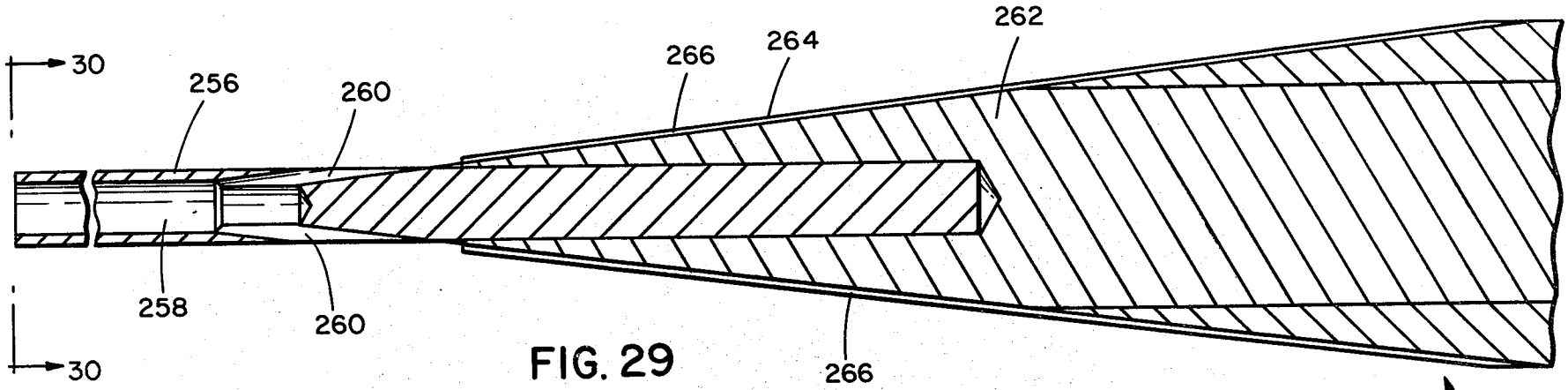
FIG. 29 is an enlarged fragmentary longitudinal cross-sectional of the arbor.
Figure 30:
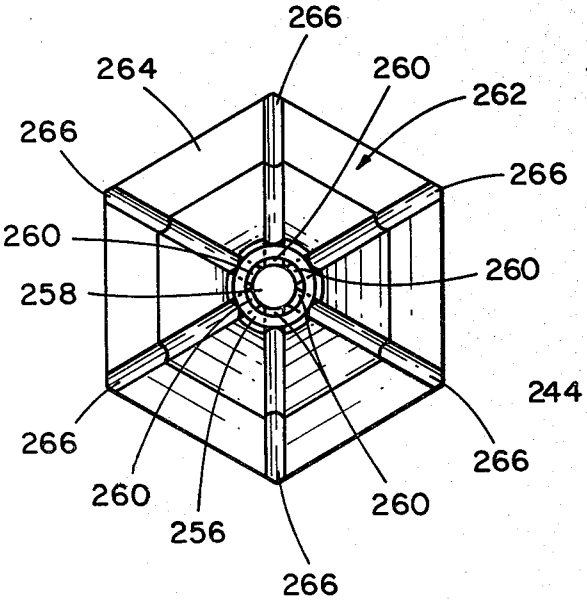
FIG. 30 is a side elevational view of the arbor of FIG. 29.

Arbor rod 208, best shown in FIGS. 29 and 30, includes an elongate arbor 256 sized for reception inside sleeve 60 in its non-expanded condition. Arbor 256 constitutes confinement means for holding fingers 200 in their insertion position and for this purpose includes an axial bore 258 for receiving the fingers and six spaced radial apertures 260 communicating with bore 258. Arbor rod 208 further includes an intermediate portion 262 having a six-sided outside ramp surface 264 with respective sides of surface 264 being parallel to corresponding sides of ramp surface 252 of nose 250. Intermediate portion 262 includes elongate slots 266 at the corners of outside surface 264. With both tube 210 and arbor rod 208 extended, slots 266 serve as extensions of slots 244 on nose 250. Each slot 266 is aligned with a respective aperture 260 in arbor 256.

The release means includes end wall 248 of housing 206. The end wall includes a hexagonal opening 267 slightly larger in cross section than intermediate tube 210 permitting the tube to extend outside the housing. The end wall 248 has an abutment surface 268 which engages the expanded sleeve as tube 210 moves toward its retracted position to release the sleeve from its expanded condition. The corners of the end wall surface defining opening 267 are preferably slotted to partially receive and guide fingers 200.

Figure 27:
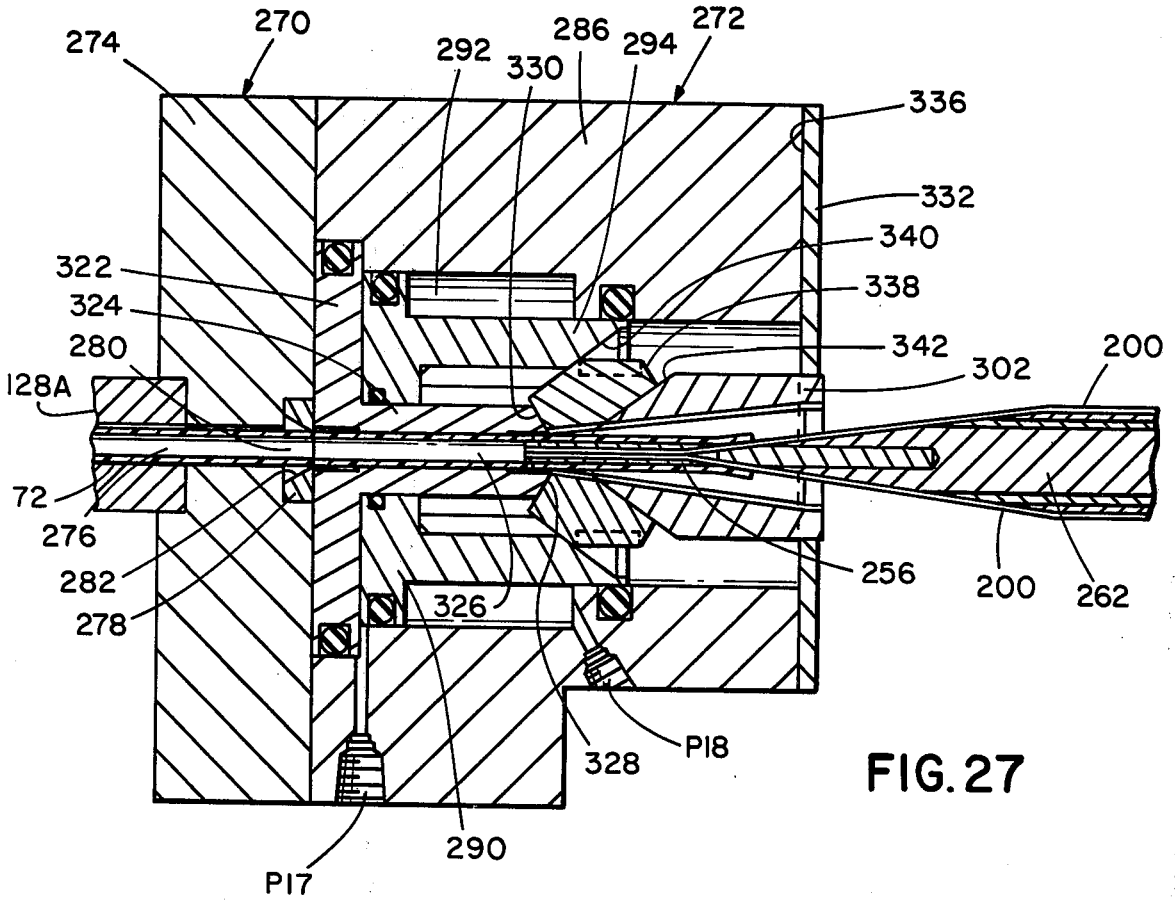
FIG. 27, similar to FIG. 25, illustrates the guide means in its retracted position and an insulating sleeve disposed over the arbor and in engagement with the wires.

Guide assembly 204 for guiding the fingers to their insertion position includes tubing feeder 68A, cutter means 270 for severing sleeve 60 from the remainder of length of tubing 72, and guide means 272 engagable with fingers 200 for moving the fingers generally radially inwardly as they are longitudinally moved from their expansion position. Cutter means 270 and means 272 are best shown in FIGS. 25–27. Cutter means 270 includes a cutter support 274 having an axial bore 276 for receiving non-expanded tubing from feeder 68A. A cutter shaft 278 having an aperture 280 for receiving the tubing and defined by an annular knife surface 282, is guided by support 274. Shaft 278 is connected to the rod of a cylinder 284. When the cylinder extends shaft 278, knife surface 282 severs sleeve 60 from the remainder of the length of tubing. The cylinder 284 is spring biased to a retracted position wherein aperture 280 is concentric with bore 276.

Figure 34:
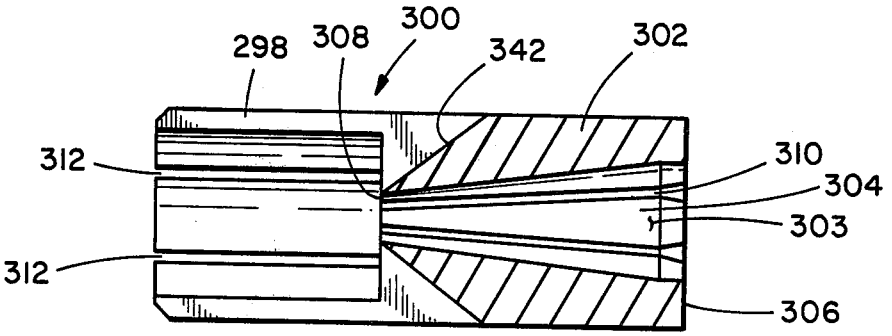
FIG. 34 is a longitudinal cross-sectional view of a component of the finger guide assembly.

Guide assembly 204 also includes a housing 286 attached to cutter support 274. Guide means 272 comprises a piston 290 disposed in a piston chamber 292 in housing 286. The housing includes ports P17 and P18 for supplying air to the respective faces of piston 290. The piston includes an elongate generally cylindrical extension 294. A cam holding portion 298 of a one-piece guide component 300, best shown in FIG. 34, is press fit into extension 294 and an intermediate cam guiding sleeve 296 is disposed within cam holding portion 298. Guide component 300 includes a finger guide 302 for guiding fingers 200 toward their insertion position and further has an axial bore 304 aligned with bore 280 of cutter support 274 and sufficiently large to receive sleeve 60 in its non-expanded condition. As will be explained more fully hereinafter, bore 304 first receives arbor 256 and thereafter receives sleeve 60 as it is pushed over the arbor.

More specifically, finger guide 302 has an inside surface 303 defining bore 304 and has a finger entry face 306 and a finger exit face 308. Inside surface 303 in cross section is substantially the shape of a regular polygon having sides equal to the number of fingers 200. Each corner of surface 303 includes a respective elongate groove 310 shaped complimentary to a respective finger 200 for at least partially receiving the finger. Grooves 310 extend between entry face 306 and exit face 308 and converge in the direction of the exit face. Grooves 310 are aligned with slots 244 of intermediate tube 210 when sleeve installer module 202 and guide assembly 204 are aligned in their sleeve-feeding position. Furthermore, the portions of grooves 310 adjacent entry face 306 are enlarged to act as funnels for initially directing finger 200 into finger guide 302.

Figure 35:
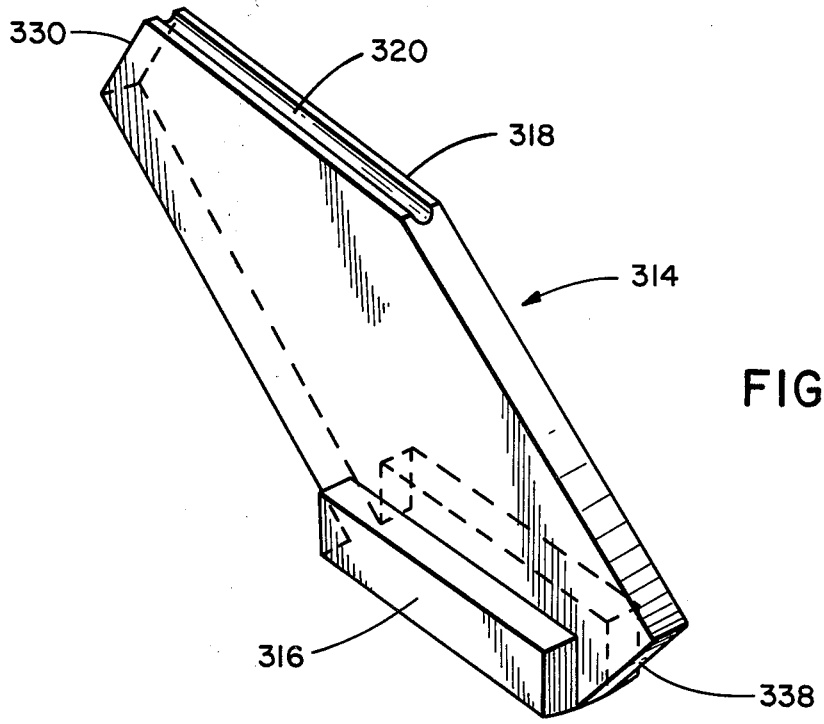
FIG. 35 is a perspective view of a cam member used in conjunction with the guide means.
Figure 36:
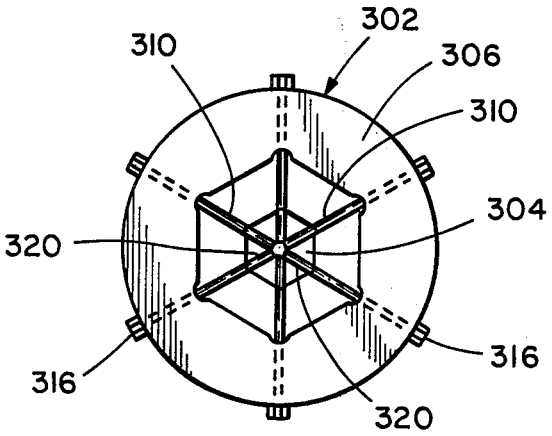
FIG. 36 is a right side elevational view of the guide means of FIG. 34 showing the plurality of cam members in their extended positions to guide the wires inside the arbor.
Figure 37:
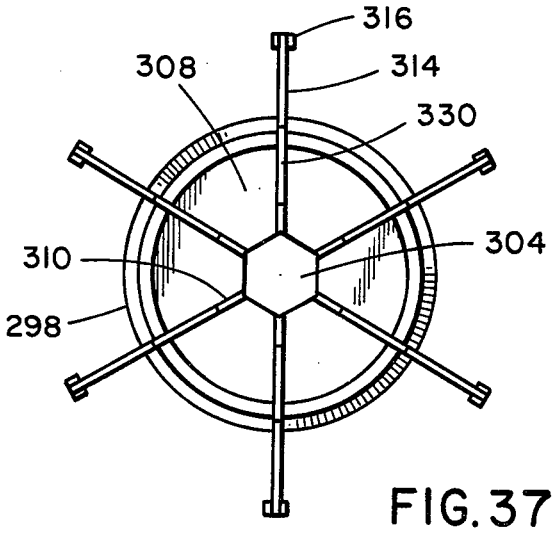
FIG. 37 is a left side elevational view of the guide means of FIG. 34 showing the cam members in their retracted positions to provide sufficient clearance for the insulative sleeve to move through the guide means.

The cam-holding portion 298 of guide component 300 is generally cylindrical and includes six spaced narrow elongate radial slots 312 each receiving a cam member 314 best shown in FIG. 35. Cam members 314 constitute means for directing respective fingers 200 into corresponding apertures 260 of arbor 256 as the fingers are longitudinally moved from their expansion position towad their insertion position. Each cam member comprises a T-shaped head 316 engagable with the outside surface of cam-holding portion 298 and also includes a sloping surface 318 having a groove 320 for directing a finger 200 from a finger guide groove 310 into an arbor aperture 260. Cam members 314 are movable between an extended position, shown in FIG. 36, in which they are disposed inside bore 304 and a retracted position, see FIG. 37, in which they are removed from bore 304.

Referring to FIG. 25, the guide assembly 204 further includes a tubing guide 322 disposed in housing 286 between piston 290 and cutter support 274. Tubing guide 322 includes an elongate cylindrical extension 324 fo reception within bore 304 of camholding portion 298. Guide 322 also has a central bore 326 for receiving sleeve 60 in its nonexpanded condition and extension 324 includes an abutment surface 328 engagable with a retract cam surface 330 of cam member 314 for causing the cam members to retract. Also included in guide assembly 204 is an end wall 332 having an opening 334 permitting finger guide 302 to extend outside housing 286. End wall 332 also includes an abutment surface 336 engagable with an extend cam surface 338 of cam members 314 for causing the cam members to extend. Cam members 314 are slidable on annular ramp surface 340, 342 of piston extension 294 and finger guide 302, respectively, to be movable relative to guide component 300 between an extended position, shown in FIG. 25, wherein the respective grooves 320 of the cam members are aligned with the respective grooves 310 of finger guide 302 and the spacing between the cam members is insufficient for passage of sleeve 60 therebetween and a retracted position, shown in FIG. 27, wherein the spacing between cam members is sufficient for passage for sleeve 60 therebetween.

Figure 38:
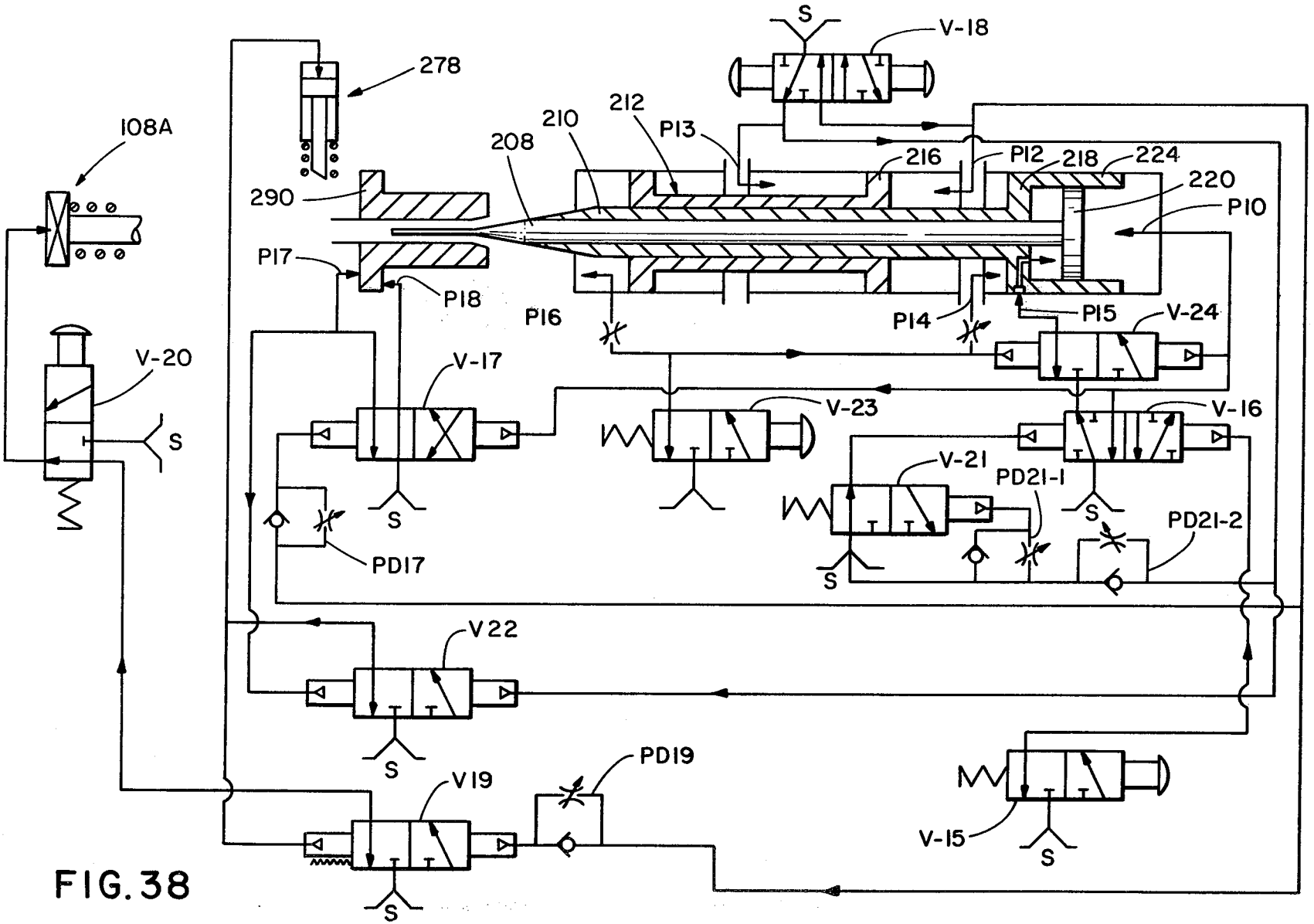
FIG. 38 is a schematic diagram of various pneumatic components used in controlling the tubing feeder and guide assembly and the sleeve installer of expander module.

Referring now to FIG. 38, a pneumatic circuit for controlling sleeve installer module 202 and guide assembly 204 comprises the following valves having their respective source inputs (S) connected to a factory air supply: a pushbutton operated, spring returned three-way arbor extend valve V15; a double pilot actuated four-way arbor control valve V16 which selectively supplies air to ports P10 and P15; a double pilot controlled four-way guide means control valve V17 which selectively supplies air to ports P17 and P18; a double pushbutton operated four-way finger control valve V18 for selectively providing air to ports P12 and P13; a double pilot actuated three-way tubing feeder control valve V19; a pushbutton operated, spring returned three-way valve V20 for initially feeding the tubing 72 into the guide assembly 204; a double pilot actuated three-way shear cylinder control valve V22; and a pushbutton operated, spring returned three-way sleeve release valve V23 for selectively providing air to ports P14 and P16. Additionally, the pneumatic circuit of the alternate embodiment includes a double pilot actuated three-way valve V24 which functions to selectively pressurize and exhaust port P15 allowing arbor piston 220 to retract independently of intermediate tube piston 218. The pneumatic circuit also includes a pilot operated, spring returned three-way arbor retract valve V21 and pneumatic time delays PD17, PD19, and PD21-1 and PD21-2 connected to delay switching of valves V17, V19, and V21, respectively.

Operation of the alternate embodiment of apparatus of the present invention for applying an insulating sleeve 60 to a connector 62 is as follows: It is assumed that sleeve installer module 202 is initially in its connector-receiving position, shown in FIG. 22, spaced from guide assembly 204. Additionally, as shown in FIG. 23, arbor 256 and fingers 200 are in their retracted positions disposed inside of housing 206 and intermediate tube 210 is extended holding sleeve 60 in its expanded condition. Furthermore, referring to FIG. 27, piston 290 of guide means 272 is in engagement with tubing guide 322 and cam members 314 are in their retracted position. It is noted that operation of the pushbutton of valve 20 causes the rod of tubing feeder cylinder 108A to initially feed tubing 72 through bore 280 of cutter support 274 into extension 324 of the tubing guide 322.

Figure 24:
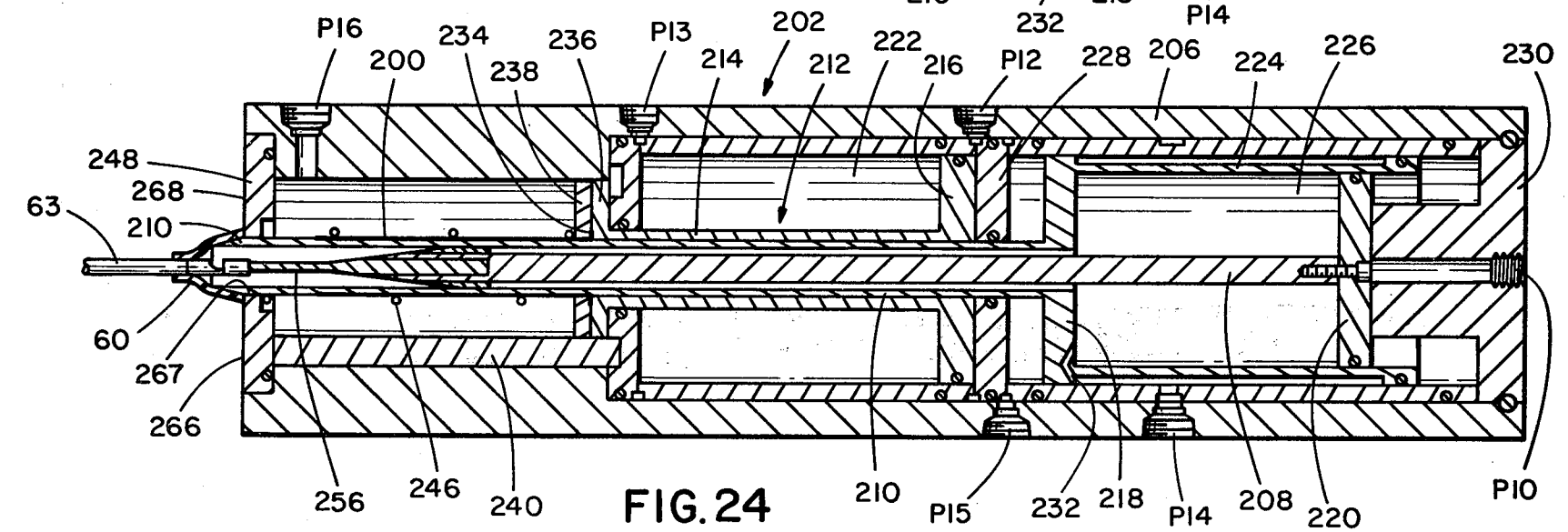
FIG. 24, similar to FIG. 23, shows the intermediate tube as it moves towards its retracted position freeing the sleeve to contract about the connector.

After connector 62 is moved, terminal end portion 59 first, into bore 254 of intermediate tube 210 until the connector engages arbor 256, the pushbutton of valve V23 is depressed causing air to be supplied simultaneously through port P16 to slots 244 of tube 210 causing the sleeve 60 to expand slightly and at least partially lift off the outside surface of tube 210, and through port P14 causing tube 210 to move toward its retracted position, see FIG. 24. Concurrently valve V23 supplies air to the left pilot of valve V24 causing valve V24 to shift to exhaust port P15. Sleeve 60 is prevented from following tube 210 by abutment surface 268 of end wall 248 and the sleeve is free to contract about connector 62. It is noted that as sleeve 60 is preferably slightly longer than connector 62, the sleeve also engages a portion of wire 63 adjacent the connector.

To expand a subsequent sleeve 60 the sleeve installer module is moved to its sleeve feeding position, as shown in FIG. 21, wherein module 202 and guide assembly 204 are aligned. Actuation of the pushbutton of valve V15 supplies a pneumatic signal to the right pilot of valve V16 shifting the valve to supply air through port P10 causing arbor rod 208 to extend through opening 334 in guide assembly housing 286 end wall 332 and into bore 304 of finger guide 302. Valve V16 sends a signal to the right pilot of valve V24 which in response shifts positions to exhaust port P15 through itself and valve V16. Valve V16 also concurrently provides a signal to the right pilot of valve V17 which switches position to supply air to the left side of piston 290 through port P17 causin guide means 272 to move toward sleeve installer module 202. As the guide means so moves, extended cam surfaces 338 of cam members 314 engage abutment surface 336 of end wall 332. With continued movement of the guide means toward module 202, cam members 314 are compelled to slide radially inwardly on the annular ramp surfaces 340, 342 of piston extension 294 and finger guide 302, respectively, until the cam members 314 are in their extended position, shown in FIG. 25, with their finger-receiving grooves 320 aligned with grooves 310 of finger guide 302 (see FIG. 36) for directing fingers 200 through apertures 260 of arbor 256 into bore 258. The slots 244, 266 of intermediate tube 210 and the intermediate portion 262 of arbor rod 208, respectively, are now disposed facing the grooves 310, 320 of finger guide 302 and cam members 314, respectively. Valve V17 also supplies a signal to the left pilot of valve V22 switching the valve to exhaust air cylinder 278 so that under the spring bias of the cylinder, cutter shaft 278 returns to a position wherein its bore 280 is concentric with bore 276 of cutter support 274. The cutter shaft has previously severed a sleeve 60, now positioned in tube guide extension 324, from the remainder of length of tubing 72.

Operation of the right side pushbutton of valve V18 switches the valve to provide air through port P12 and to exhaust port P13 causing outer finger-carrying tube 214 to extend toward the guide assembly 204. As fingers 200 extend, they are received by grooves 310 of finger guide 302 which guides the fingers so that they move radially inwardly. The fingers, as they continue to extend longitudinally, are received by the grooves 320 of the respective cam members 314 which similarly continue to direct them radially inwardly into the respective apertures 260 of arbor 256 and thereafter into arbor bore 258 where the fingers are in their insertion position. Valve V18 also supplies air to the left pilot of valve V17 through pneumatic time delay PD17 and to the right pilot of valve V19 through pneumatic time delay PD19. The time delay associated with PD19 is greater than that of PD17 and both time delays are of sufficient duration to prevent valves V17 and V19 from switching positions before fingers 200 move to their insertion position. When valve V17 switches in response to the pilot signal, it supplies air through port P18 to move guide means 272 away from sleeve installer module 202. During this movement retract cam surfaces 330 of cam members 314 engage abutment surface 328 of tube guide extension 324 as shown in FIG. 27. As the guide means 272 continues to move away from module 202, the cam members slide radially outwardly on the annular ramp surfaces 340, 342 of piston extension 294 and finger guide 302, respectively, until the cam fingers are in their extended position, shown in FIG. 27, wherein the spacing between the cam members is greater than the outside diameter of nonexpanded sleeve 60.

It should be noted that with the cam members no longer engaging flexible fingers 200, only the end portion of the fingers are securely held: one end portion of the wires held by arbor 256; the other end portion of the wires held between tube flange 236 and cap 238. Due to the resiliency of the wire fingers and the bend in the fingers are caused by their confinement in arbor 256, the portions of the fingers disposed adjacent the intermediate portion 262 of arbor rod 208 bulge out slightly so as to lift slightly off the outside ramp surface 264 of intermediate portion 262.

When valve V19 switches, it supplies air through valve V20 to extend the rod of tube feeder drive cylinder 108A which causes feeder 68A to feed tubing through the cutter support 274 and into tube guide 322. This causes the previously severed sleeve 60 to be pushed over arbor 256 and into engagement with fingers 200, as shown in FIG. 27. The leading end of sleeve 60 expands slightly and exerts a compressive force on the slightly bulged portions of the fingers disposed over intermediate arbor portion 262 causing the fingers to return toward slots 266. Thus, good frictional engagement between the leading portion of the sleeve 60 and fingers 200 is established. It is noted that fingers 200 extended further toward cutter support 274 than does sleeve 60.

Next, the left pushbutton of valve V18 is actuated switching the valve to supply air through port P13 and to exhaust port P12 causing finger carrying tube assembly 212 to move away from guide assembly 204. Valve V18 also provides air to the right pilot of valve V22, to the source input S of valve V21 through pneumatic time delay PD21-2 providing a delay longer than the time required for tube assembly 212 to move from its extended position to its retracted position before air is supplied to the left pilot of valve V16 which switches positions to provide air to port P15 through valve V24 thereby retracting arbor piston 220, and to the pilot of valve V21 through an additional pneumatic time delay PD21-1 which switches valve V21 to exhaust the left pilot of valve V16.

Figure 28:
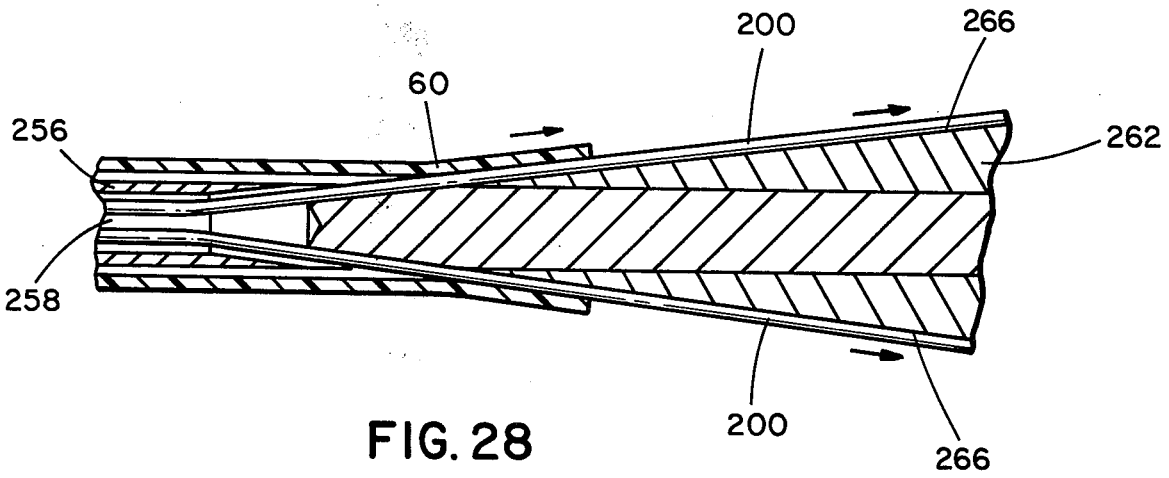
FIG. 28 is an enlarged sectional view showing the outer finger carrying tube moving toward its retracted position causing the wire fingers to expand the sleeve.

Referring to FIG. 28, as the fingers 200 are moved from their insertion toward their expansion position, they are guided by slots 266 of arbor intermediate portion 262 and slots 244 of intermediate tube nose 250 causing the fingers to move radially outwardly as they are longitudinally retracted. The slopes of ramp surfaces 264 of arbor intermediate portion 262 and of ramp surface 252 of intermediate tube nose 250 are both are exemplary seven degrees. The frictional engagement between the inside surface of sleeve 60 and fingers 200 causes the sleeve to move and radially expand with the fingers. Thus, each finger causes sleeve 60 to expand along a plane through the axis of the sleeve with the angle between adjacent planes being substantially equal to 360 degrees divided by the number of fingers 200. It is noted that the fingers have a sufficiently large diameter and slots 244, 266 are sufficiently shallow so that sleeve 60 is held out of such substantial frictional engagement with ramp surfaces 252 and 264 that the sleeve fails to ride on the fingers. Fingers 200 move on the fly through their expansion position, wherein sleeve 60 is fully expanded and positioned above intermediate tube 210 with fingers 200 disposed therebetween, toward their retracted position inside housing 206 and out of engagement with the sleeve. As the fingers retract from their expansion position, sleeve 60 engages abutment surface 268 of housing end wall 248 which precludes the sleeve from further following the fingers, and the sleeve becomes disposed on the outside surface of intermediate tube 210 expanded sufficiently to receive connector 62.

Valve V22 which switches positions concurrently with movement of fingers 200, supplies air to the cutter means air cylinder 278 causing knife surface 282 to sever another sleeve 60 which is disposed in tube guide 322. Valve V22 is also connected to supply air to the left pilot of valve V19 which exhausts tube feeder drive cylinder 108A allowing its spring-biased rod to retract. As mentioned above, thereafter the arbor retracts inside housing 206.

The sleeve installer module 202 with intermediate tube 210 extending and holding another sleeve 60 expanded is ready to be moved to its connector-receiving position for insulating another connector 62.

A suitable resilient expandable insulating tubing for use with the alternate embodiment of the present invention is silicone rubber having a nominal inside diameter of 0.078 inches and a nominal wall thickness of 0.025 inches.

In view of the above, it will be seen that the several subjects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. Apparatus for insulating a connector mechanically joined to one end of an electrical conductor by positioning a radially expandable resilient insulating sleeve, having an inside diameter in its non-expanded condition smaller than the largest cross-sectional dimension of said connector about said connector, said sleeve in its non-expanded condition having a generally uniform wall thickness and a generally constant inside diameter throughout its length, said connector including one end portion mechanically joined to said conductor and a terminal end portion for connection to another electrical component, said apparatus comprising:

expansion means for radially expanding said sleeve sufficiently to receive said connector prior to association of the connector with said apparatus, said expansion means increasing every inside cross-sectional dimension of said sleeve and simultaneously radially expanding substantially the entire length of said sleeve; and holding means for maintaining said sleeve in its expanded condition and for permitting said connector to be received, terminal end portion first, into said expanded sleeve; and release means operable to release said sleeve from its expanded condition whereby after said sleeve is held expanded and said connector inserted therein, operation of said release means frees said sleeve to become disposed about and compressively hold said connector, said sleeve is an end portion of a length of radially expandable resilient insulating tubing, said apparatus further comprising cutter means for severing said sleeve in its expanded condition from the remainder of said length of tubing.

2. Apparatus for positioning an insulating sleeve about an object such as a connector joined to an electrical conductor, said apparatus comprising:

sealing means for providing two spaced seals in a length of radially expandable resilient insulating tubing having an inside diameter, in its stable condition, smaller than the largest cross-sectional dimension of said object;

expansion means for introducing pressurized fluid into said tubing between said seals until a portion of said tubing has expanded sufficiently to receive said object;

holding means for maintaining said portion in its expanded condition after the application of fluid pressure into the tubing has terminated; and release means operable to release said portion from its expanded condition whereby after the portion of the tubing is held in its expanded condition, said object can be inserted into said portion and the release means operated so that said portion is disposed about and compressively holds said object, said apparatus further comprising feeder means for feeding said portion of said tubing and further comprising cutter means for severing the expanded portion of said tubing from the remainder of said length of tubing.

3. Apparatus for positioning an insulating sleeve about an object such as a connector joined to an electrical conductor, said apparatus comprising:

sealing means for providing two spaced seals in a length of radially expandable resilient insulating tubing having an inside diameter, in its stable condition, smaller than the largest cross-sectional dimension of said object;

expansion means for introducing pressurized fluid into said tubing between said seals until a portion of said tubing has expanded sufficiently to receive said object;

holding means for maintaining said portion in its expanded condition after the application of fluid pressure into the tubing has terminated; and release means operable to release said portion from its expanded condition whereby after the portion of the tubing is held in its expanded condition, said object can be inserted into said portion and the release means operated so that said portion is disposed about and compressively holds said object, said apparatus further comprising feeder means for feeding said portion of said tubing and further comprising an expansion chamber for receiving the portion of said length of tubing to be expanded, said apparatus further comprising cutter means for severing the expanded portion of said tubing from the remainder of said length of tubing; at least part of the aforementioned sealing means, expansion means, holding means, release means, expansion chamber and cutter means being included in a sleeve installer which is movable between a first position wherein it is aligned with said feeder means to receive said portion of said tubing and a second position wherein it is remote from said feeder means and said expansion chamber is open to receive said object within the expanded portion of said tubing.

4. Apparatus as set forth in claim 3 further comprising a sequencer for selectively operating said scaling means, expansion means, holding means, release means, cutter means, feed means, and positioning of said sleeve installer module.

5. Apparatus as set forth in claim 3 wherein said expansion chamber is disposed at one end of said sleeve installer, said holding means comprising a portion of a shear tube movable between a holding position wherein said tube extends into said expansion chamber and a release position wherein said tube is withdrawn from said expansion chamber.

6. Apparatus as set forth in claim 5 wherein said release means comprises means for moving said tube to its release position.

7. Apparatus as set forth in claim 5 wherein said expansion means comprises an arbor having an axial air passageway and movable between an expansion position wherein it extends inside tubing disposed in said expansion chamber and a second position wherein it is retracted from said expansion chamber.

8. Apparatus as set forth in claim 7 in which said sleeve installer is elongate and includes an arbor piston chamber and a coaxial, longitudinally spaced shear tube piston chamber.

9. Apparatus as set forth in claim 8 wherein said tube piston chamber is coaxial with said expansion chamber.

10. Apparatus as set forth in claim 7 wherein said sleeve installer comprises an arbor base carrying said arbor, said base including a generally circular first sealing lip extending into said expansion chamber when said arbor is in its expansion position.

11. Apparatus as set forth in claim 10 wherein said arbor is generally cylindrical having an outside diameter smaller than the inside diameter of said tubing in its stable condition, said sealing lip being concentric with said arbor and having an inside diameter substantially equal to the outside diameter of said tubing in its stable condition whereby said arbor and said first sealing lip define a well for receiving the leading end of said tubing as it is inserted into said expansion chamber.

12. Apparatus as set forth in claim 11 wherein said sealing means comprises said first sealing lip and further comprises a generally circular second sealing lip concentric with said first sealing lip, having a greater inside diameter than said first sealing lip, and extending further into said expansion chamber than said first sealing lip.

13. Apparatus as set forth in claim 12 wherein said tube is concentric with said second sealing lip and has a smaller outside diameter than the inside diameter of said second sealing lip, said tube, in its holding position, extending further into said expansion chamber than said second sealing lip.

14. Apparatus as set forth in claim 10 wherein said sealing means further comprises tubing compression means carried by said feeder means adapted to selectively compress a section of said length of tubing.

15. Apparatus as set forth in claim 14 wherein said arbor extends substantially further into said chamber than said first sealing lip and comprises a restrictor adjacent its distal end and further comprises at least one aperture for introducing said pressurized fluid inside said tubing whereby upon initial application of said fluid, the pressure in said tubing is greater between said restrictor and said first sealing lip than between said restrictor and said tubing compression means.

16. Apparatus as set forth in claim 5 wherein said shear tube holds said tubing portion in its expanded condition on the outside surface thereof, said outside surface of said tube comprising at least one generally axially extending groove terminating short of the free end of said shear tube whereby upon the introduction of pressurized fluid into said groove, said tubing portion tends to further expand and at least partially lift off the outside surface of said shear tube.

17. Apparatus as set forth in claim 5 wherein said shear tube is electrically conductive and said arbor is electrically conductive and electrically insulated from said shear tube, said apparatus comprising control circuitry responsive to concurrent engagement of said shear tube and said arbor by said connector to actuate said release means.

18. Apparatus as set forth in claim 17 wherein said control circuitry comprises an electrically conductive coil spring connected to said arbor.

19. Apparatus as set forth in claim 5 wherein said cutter means comprises a sharpened end portion of said shear tube.

20. Apparatus for positioning an insulating sleeve about an object such as a connector joined to an electrical conductor, said apparatus comprising:

sealing means for providing two spaced seals in a length of radially expandable resilient insulating tubing having an inside diameter, in its stable condition, smaller than the largest cross-sectional dimension of said object;

expansion means for introducing pressurized fluid into said tubing between said seals until a portion of said tubing has expanded sufficiently to receive said object;

holding means for maintaining said portion in its expanded condition after the application of fluid pressure into the tubing has terminated; and release means operable to release said portion from its expanded condition whereby after the portion of the tubing is held in its expanded condition, said object can be inserted into said portion and the release means operated so that said portion is disposed about and compressively holds said object, said apparatus further comprising feeder means for feeding said portion of said tubing and further comprising an expansion chamber for receiving the portion of said length of tubing to be expanded, said apparatus comprising control circuitry including means responsive to positioning of the object in said expansion chamber to actuate said release means.

21. A method of insulating a connector mechanically joined to one end of an electrical conductor by positioning a radially expandable resilient insulating sleeve, having an inside diameter in its non-expanded condition smaller than the largest cross-sectional dimension of said connector about said connector, said sleeve in its non-expanded condition having a generally uniform wall thickness and a generally constant inside diameter throughout its length, said connector including one end portion mechanically joined to said conductor and a terminal end portion for connection to another electrical component, said sleeve having a length at least substantially equal to that of said one end portion of said connector; said method comprising the following steps:

radially expanding said sleeve sufficiently to receive said connector prior to association of said connector with said sleeve, every inside cross-sectional dimension of said sleeve being increased and substantially the entire length of said sleeve being simultaneously radially expanded;

holding said sleeve in its expanded condition;

inserting said connector, terminal end portion first, into said expanded sleeve; and releasing said sleeve from its expanded condition whereby said sleeve contracts about and effectively insulates said connector, said sleeve is the end portion of a length of radially expandable resilient insulating tubing, said method further comprising the step of severing said sleeve from the remainder of said length of tubing after expanding said tubing and before inserting said connector into said sleeve.

22. A method of insulating an object such as an electrical connector or the like comprising the following steps:

providing two spaced seals in a length of resiliently radially expandable insulative tubing having an inside diameter, in its stable condition, smaller than the largest cross-sectional dimension of said object;

introducing, prior to association of said object and said tubing, a pressurized fluid into said tubing between said seals until a portion of the tubing between said seals expands sufficiently to receive said object;

maintaining the expanded portion in its expanded condition;

inserting said object into said expanded portion; and releasing said expanded portion from its expanded condition whereby said expanded portion contracts and forms an insulating sleeve about said object, said method further comprising the step of transversely cutting said tubing between said seals, the last-mentioned step being performed before the step of inserting the object into said expanded portion.

* * * * *